US010760192B2

(12) United States Patent
Lv et al.

(10) Patent No.: US 10,760,192 B2
(45) Date of Patent: Sep. 1, 2020

(54) WASHING MACHINE HAVING SEPARATE WASHING ARRANGEMENTS

(71) Applicant: QINGDAO HAIER WASHING MACHINE CO., LTD., Qingdao, Shandong Province (CN)

(72) Inventors: Peishi Lv, Qingdao (CN); Qingming Zhai, Qingdao (CN); Yingxi Zhu, Qingdao (CN); Zhiwei Xu, Qingdao (CN); Yanjuan Niu, Qingdao (CN)

(73) Assignee: QINGDAO HAIER WASHING MACHINE CO., LTD., Qingdao (CN)

( * ) Notice: Subject to any disclaimer, the term of this patent is extended or adjusted under 35 U.S.C. 154(b) by 331 days.

(21) Appl. No.: 15/737,360

(22) PCT Filed: Nov. 30, 2015

(86) PCT No.: PCT/CN2015/095912
§ 371 (c)(1),
(2) Date: Feb. 13, 2018

(87) PCT Pub. No.: WO2016/201907
PCT Pub. Date: Dec. 22, 2016

(65) Prior Publication Data

US 2018/0171525 A1 Jun. 21, 2018

(30) Foreign Application Priority Data

Jun. 16, 2015 (CN) ..... 2015 1 0332618

(51) Int. Cl.
*D06F 29/00* (2006.01)
*D06F 31/00* (2006.01)
(Continued)

(52) U.S. Cl.
CPC ..... *D06F 29/00* (2013.01); *D06F 31/00* (2013.01); *D06F 35/007* (2013.01); *D06F 37/12* (2013.01);
(Continued)

(58) Field of Classification Search
CPC ..... D06F 31/00; D06F 35/007; D06F 37/12; D06F 33/02; D06F 39/005; D06F 39/12; D06F 2220/00
(Continued)

(56) References Cited

U.S. PATENT DOCUMENTS

2005/0257577 A1* 11/2005 Lyu ..... D06F 39/12 68/12.23

OTHER PUBLICATIONS

CN204224870U—machine translation (Year: 2015).*
CN103437131A—machine translation (Year: 2013).*

* cited by examiner

*Primary Examiner* — Tinsae B Ayalew
(74) *Attorney, Agent, or Firm* — Jiwen Chen; Jacobson Holman PLLC

(57) ABSTRACT

A washing machine having separate washing arrangements, comprising a housing (1), and, arranged within said housing (1), a first automatic washing system (2) and a second automatic washing system (3). The housing (1) contains a first washing area (4) for accommodating the first automatic washing system (2) and a second washing area (5) for accommodating the second automatic washing system (3), said first washing area (4) and second washing area (5) being arranged one on the left and the other on the right. The vertical plane upon which are located the axis of the first automatic washing system (2) and the axis of the second automatic washing system (3) and the vertical plane of the center line of the top of the present washing machine form an angle. Arrangement of the first automatic washing system
(Continued)

(2) and the second automatic washing system (3) within the housing (1) provides a single washing machine with separate washing functions, and a user may choose according to need whether to operate one automatic washing system or both automatic washing systems at the same time. An auxiliary functional area (6) provided within the housing (1) makes more rational use of the space within the housing (1), and allows for a more compact arrangement of the two automatic washing systems, which reduces the volume of the housing (1).

10 Claims, 27 Drawing Sheets

(51) Int. Cl.

| | |
|---|---|
| ***D06F 35/00*** | (2006.01) |
| ***D06F 37/12*** | (2006.01) |
| *D06F 39/12* | (2006.01) |
| *D06F 33/00* | (2020.01) |
| *D06F 34/28* | (2020.01) |

(52) U.S. Cl.
CPC ..... *D06F 33/00* (2013.01); *D06F 34/28* (2020.02); *D06F 39/12* (2013.01); *D06F 2220/00* (2013.01)

(58) Field of Classification Search
USPC ..... 68/27
See application file for complete search history.

WASHING MACHINE HAVING SEPARATE WASHING ARRANGEMENTS

This is a U.S. national stage application of PCT Application No. PCT/CN2015/095912 under 35 U.S.C. 371, filed Nov. 30, 2015 in Chinese, claiming priority of Chinese Application No. 201510332618.2, filed Jun. 16, 2015, all of which are hereby incorporated by reference.

TECHNICAL FIELD

The present invention belongs to the technical field of washing machine, in particular to a washing machine having the sorting laundry function.

BACKGROUND

Washing machines have become our necessities of life at present, and generally each family has a washing machine. However, in our daily life, it is suggested that different types of clothes should not be washed together. Clothes should be sorted and washed separately: coat and underwear should be washed separately; baby's clothes and adult's clothes should be washed separately; and all clothes should be sorted with colors, soil levels and materials. Apparently it takes a long time to run wash progress multiple times after sorting, especially if there are more clothes needs to be washed. Moreover, a preferred washing machine has not been provided for the requirement that only small items, underwear or baby's clothes to be washed. In consideration of space, people are reluctant to buy another washing machine, however it takes more time and efforts to wash part of them by hand, especially clothes is hard to rinse clean by hand-washing.

TECHNICAL SOLUTIONS

The present invention provides a washing machine with dual washing systems, in which a first automatic washing system and a second automatic washing system are arranged in a shell, so that the sorting laundry function could be achieved by only one washing machine.

To achieve the above objective, the present invention adopts the following technical solutions:

A washing machine with dual washing systems includes a shell, a first automatic washing system and a second automatic washing system, the first automatic washing system and the second automatic washing system are disposed in the shell; the shell has a first washing area accommodating the first automatic washing system and a second washing area accommodating the second automatic washing system, the first washing area and the second washing area are arranged along the direction from left to right; an included angle forms by a vertical plane where the axis of the first automatic washing system and the axis of the second automatic washing system lie in and a vertical plane where the center line of the top of the shell lies in.

Further, the included angle is 10° to 20°.

Preferably, the included angle is 13° or 16°.

Further, the first automatic washing system and the second automatic washing system are fully automatic washing system, and a water supply system and a drainage system is used by the first automatic washing system and the second automatic washing system together.

Further, a control system controls the first automatic washing system and the second automatic washing system and the spinning cycle of the first automatic washing system and the second automatic washing system starts at different time under the control of the control system.

Further, the washing capacity of the first automatic washing system is larger than that of the second automatic washing system.

Further, the shell has an auxiliary functional area adjacent to the first washing area and the second washing area.

Further, the auxiliary functional area is half-enclosed by the first washing area and the second washing area.

Further, the auxiliary functional area and the second washing area are arranged back and forth.

Further, the auxiliary functional area and the first washing area are disposed along the direction from left to right.

Further, the auxiliary functional area is provided with a storage module.

Further, the auxiliary functional area is provided with a health module.

Further, the auxiliary functional area is provided with a third automatic washing system.

Further, the washing machine further has a display operation module disposed on the top of the auxiliary functional area.

Further, the first automatic washing system and the second automatic washing system are pulsator-type automatic washing systems.

Further, the first automatic washing system comprises a first washing cylinder, the second automatic washing system comprises a second washing cylinder, and the minimum distance between the first washing cylinder and the second washing cylinder is 15 mm to 30 mm.

Preferably a minimum distance between the first washing cylinder and the second washing cylinder is 25 mm.

In order to increase the strength of the shell, the shell comprises a frame and a shell body which is arranged on the outside of the frame, wherein the frame comprises an upper frame, a base and a plurality of vertical beams which are arranged between the upper frame and the base, the upper frame is provided with an upper middle beam in the front-rear direction, a bottom middle beam in the front-rear direction is arranged on the base, the vertical plane where the upper middle beam and the bottom middle beam in divides the room enclosed by the shell into two parts.

Further, the first washing area is located on one side, and the second washing area and the auxiliary functional area are located on the other side.

Further, the upper middle beam is provided with a first hanging structure holding the first automatic washing system and a second hanging structure holding the second automatic washing system, the upper middle beam, the first hanging structure and the second hanging structure are in one piece by molding.

Further, the first automatic washing system is hanged in the first hanging structure by a suspension, and the first hanging structure has a concave receiving portion, and the bottom of the concave receiving portion is provided with a downward convex working hole matched with the suspension, and the first hanging structure is provided with a channel through which the suspension enters or exits from the working hole.

Further, the working hole is connected to the bottom of the concave receiving portion through a funnel-shaped working surface, and the working surface is attached to the suspension.

Further, the inner side of the first hanging structure is provided with a downward flange.

Further, the second hanging structure is a mounting ear vertically arranged, and the mounting ear is provided with a through hole.

Further, the base includes a large square area where the first washing area is disposed and a small square area where the second washing area is disposed, and a corner area where the auxiliary functional area is disposed, wherein the large square area has a front bottom beam and the small square area has a side bottom beam, the front bottom beam and the side bottom beam extend towards each other to form a front bottom extending beam and a side bottom extending beam, and the corner area includes a corner bottom beam, the corner bottom beam includes the front bottom extending beam and the side bottom extending beam, and an arched beam connecting the front bottom extending beam and the side bottom extending beam.

Further, the upper frame has a corner upper beam corresponding to the corner bottom beam with the same structure.

Further, the upper frame comprises a large square frame where the first washing area is located and a small square frame where the second washing area is located, and the upper middle frame beam is a public side of a large square frame and a small square frame. Four corners of the large square frame are respectively provided with the first hanging structure for holding the first washing system, and four corners of the small square frame are respectively provided with a second hanging structure for holding the second washing system.

Further, the cross-section of the vertical beam has an extension portion, wherein the middle of the extension portion provided with an inwardly protruding wave-like shape and each of the two ends has an inward flange.

Further, the second automatic washing system includes the second washing cylinder, an outer cylinder cover is arranged on the second washing cylinder, a clothes access and an inner cover sliding to open and close the clothes access are provided on the outer cylinder cover and a receiving area for receiving the opening inner cover is provided inside the shell.

Further, an receiving portion for receiving the inner cover sliding horizontally from the position closing the clothes access to the position opening the clothes access is provided inside the shell.

Further, the left and right ends of the inner cover extend outwardly forming sliding pieces along the horizon direction, and two pressing pieces are provided on the outer cylinder cover on the left and right sides of the clothing access, a sliding trail receiving one of the sliding piece is provided between one of the pressing piece and the outer cylinder cover.

Further, the sliding piece includes an upward flange, the inner side of the pressing piece has a downward flange, and the upward flange is located outside the downward flange.

Further, the pressing piece further has a vertical downward baffle and the upward flange is located in the area enclosed by the pressing piece, the vertical downward baffle and the downward flange.

Further, the outer cylinder cover is provided with a plurality of mounting cylinders for arranging the pressing piece, and a connecting plate connecting any two of the mounting cylinders is disposed between the adjacent mounting cylinders.

Further, a positioning structure is provided between the inner cover and the outer cylinder cover in cooperation, and the positioning structure includes a positioning cylinder and a slot.

Further, the mounting cylinder is arranged at the front of the outer cylinder cover and the slot is arranged on the lower surface of the inner cover, one end of the slot is provided with a claw bent inwards, one end of the claw is provided an outward flange, and the other end of the slot extends outwardly to form a guiding portion; when the inner cover slides to the closing position, the mounting cylinder is located in the slot.

Further, the inner cover is of an upward arched structure, and the periphery of the inner cover extends outwardly to form a horizontal sealing edge.

Further, the sealing edge is attached to the outer cylinder cover that is in contact with the sealing edge.

Further, the outer cylinder cover is provided with a support plate; when the inner cover is opened, the inner cover slides to the support plate from the outer cylinder cover.

Further, the upper surface of the support plate is in the same horizontal plane as the upper surface of the outer cylinder cover.

Further, the outer cylinder cover is fixedly provided with a micro switch that is actuated by the inner cover, and when the inner cover is in the closing position, the micro switch is turned on; when the inner cover is being opened, the micro-switch is turned off.

Further, the micro switch is disposed on the rear portion of the outer cylinder cover, and the micro switch is provided with a switch actuator protruding forwardly, when the inner cover is in the closing position, the inner cover is in contact with the switch actuator to actuate the micro switch.

Further, the inner cover is provided with a trigger matched with the switch actuator, and when the inner cover is in the closing position, the trigger is in contact with the switch actuator to actuate the micro switch.

Further, the outer cylinder cover is provided with a shell, the micro switch is arranged in the shell, and the front wall of the shell is provided with a through hole from which the switch actuator protrudes.

Further, the rear portion of the outer cylinder cover is further provided with a stopper baffle, and when the inner cover is in the closing position, the rear end of the inner cylinder attaches to the stopper baffle.

Further, the outer cylinder cover is provided with a wiping plate; when the inner cover is opened, the wiping plate removes water droplets from the lower surface of the inner cover.

Further, the upper portion of the wiping plate is attached to the lower surface of the inner cover.

Further, the wiping plate inclines towards the closing direction of the inner cover and is tilted upwardly by a certain angle.

Preferably, an angle formed by the wiping plate and the outer cylinder cover is 10° to 30°.

Further, the wiping plate is made of elastic material.

Further, the lower end of the wiping plate is provided with a mounting block, and a mounting slot matched with the mounting block is provided on the outer cylinder cover, and the mounting block is located in the mounting slot.

Further, a fixing structure is provided on the mounting block and the mounting groove in cooperation, the fixing structure includes a fixing hole and a fixing cylinder.

Benefits and Advantages

Compared with the prior art, the advantages and positive effects of the present invention are as follows: the present invention provides a washing machine with dual washing systems, the washing machine comprises a first automatic washing system and a second automatic washing system, the first automatic washing system and the second automatic washing system are arranged in the shell, therefore sort laundry can be achieved by one washing machine, the user could select to start only one set of the automatic washing system or start both of them, an included angle forms by a vertical plane where the axis of the first automatic washing system and the axis of the second automatic washing system lie in and a vertical plane where the center line of the top of the shell lies in, therefore the inside arrangement is more compact and the overall size of the washing machine could be reduced.

Other features and advantages of the present invention will become more apparent referred to the following detailed description of the present invention in conjunction with the drawings.

EMBODIMENTS OF THE PRESENT INVENTION

To make the objectives, technical solutions, and advantages of the embodiments of the present invention clearer, the technical solutions in the embodiments of the present invention will be described clearly and completely with reference to the accompanying drawings in the embodiments of the present invention.

In the description of the present invention, it should be noted that the directions or position indicated by the terms "up", "down", "left", "right", "front" and "back" is merely for convenience in describing the present invention and simplifying the description, rather than indicating or implying that the indicated apparatus or portion must have a specific orientation and be constructed and operated in a specific orientation, and therefore should not be construed as limiting the present invention. In addition, the terms "first" and "second" are used for descriptive purposes only and are not to be construed as indicating or implying relative importance.

Figure 1:
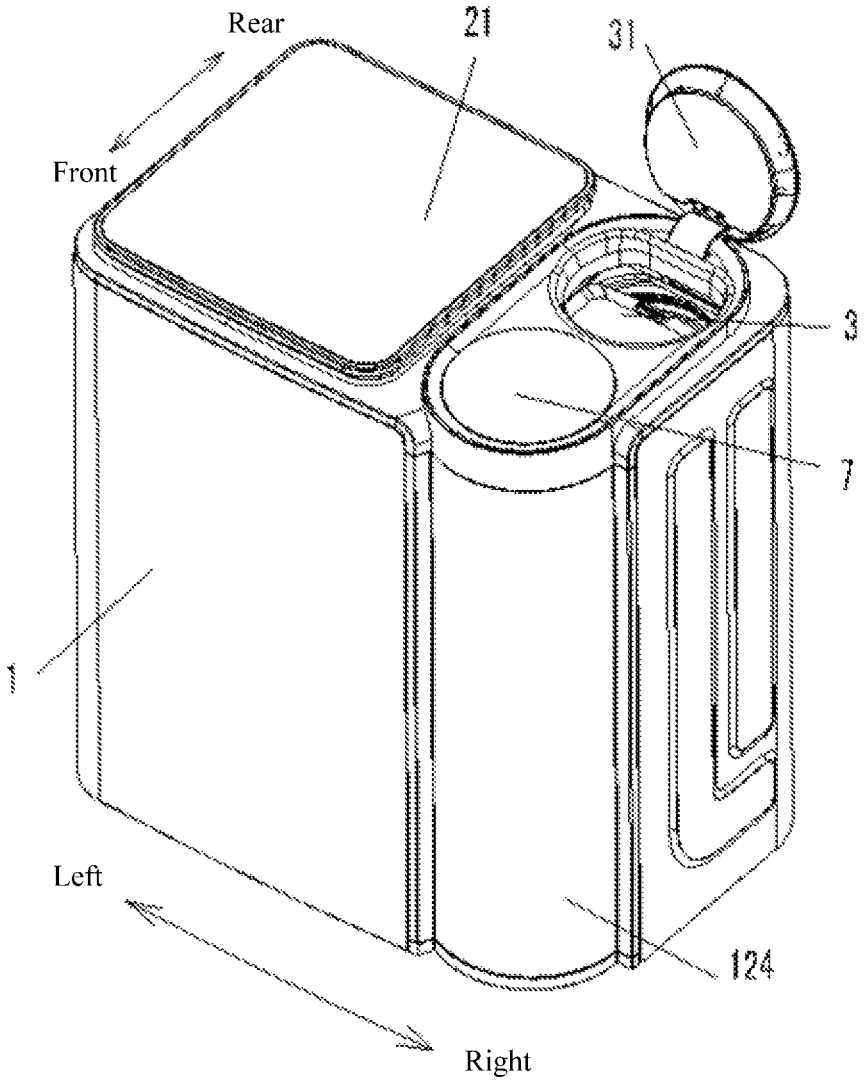
FIG. 1 is a schematic structural view of an embodiment of a washing machine with dual washing systems disclosed by the present invention.
Figure 2:
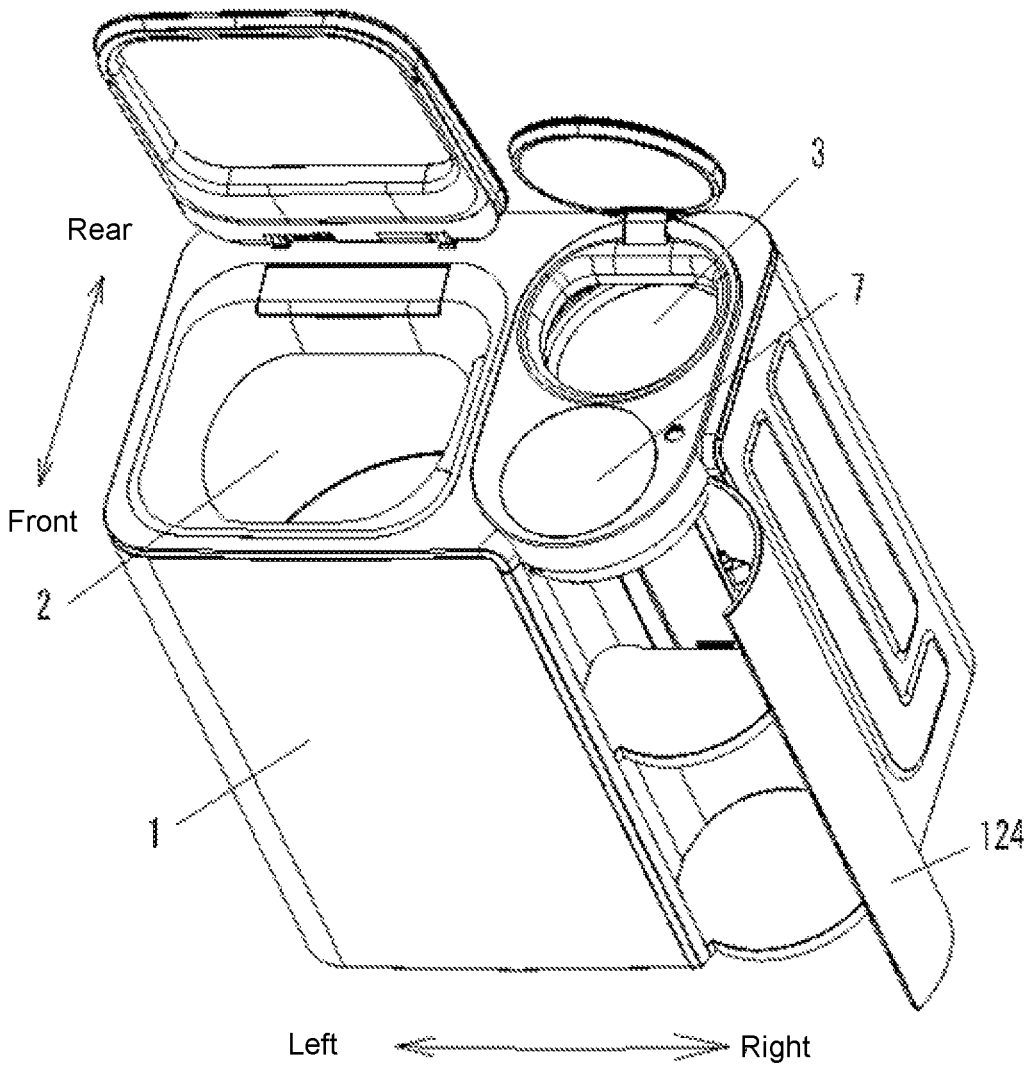
FIG. 2 is a schematic structural view in FIG. 1 from a different angle.
Figure 3:
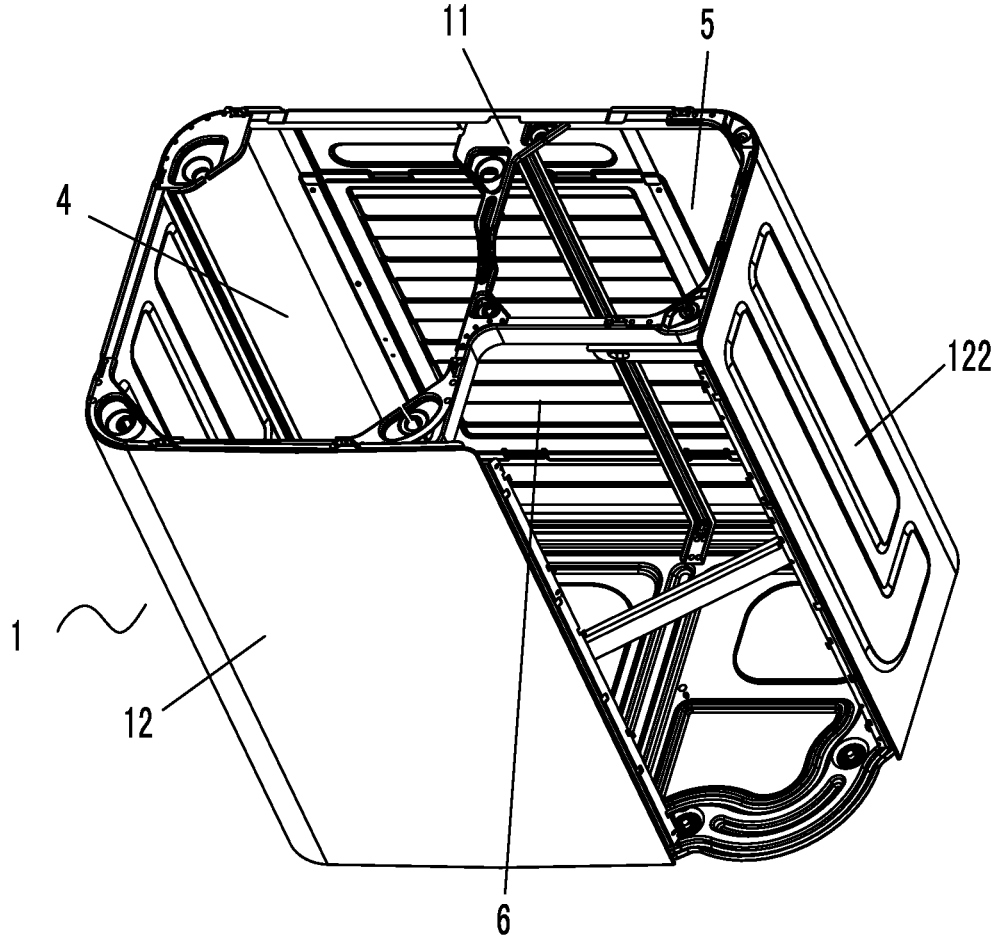
FIG. 3 is a schematic view of a specific embodiment of the shell in FIG. 1.

As shown in FIG. 1 to FIG. 3, an embodiment of the washing machine with dual washing systems is disclosed. The washing machine with dual washing systems comprises a shell 1, a first automatic washing system 2 and a second automatic washing system 3. The first automatic washing system 2 and the second automatic washing system 3 are arranged in the shell 1, so that sorted clothes could be washed with different washing systems separately, thereby being of advantageous in energy saving, health and hygiene, further could save the laundry time.

In order to illustrate the arrangement of the two washing systems in the shell 1 clearly, the area where the first automatic washing system 2 is arranged is defined as the first washing area 4, and the area where the second automatic washing system 3 is arranged is defined as the second washing area 5, and the first washing area 4 and the second washing area 5 are arranged along the direction from left to right, that is to say, the two sets of automatic washing systems are arranged along the direction from left to right. An included angle forms by the vertical plane where the axis of the first automatic washing system and the axis of the second automatic washing system lie in and the vertical plane where the center line of the top of the shell lies in. The center line of the top of the shell is the center line of the square of the top enclosed by the shell. There are a front-rear center line and a left-right center line of the top; or that is to say, the included angle is formed by the vertical plane where the axis of the first automatic washing system 2 and the axis of the second automatic washing system 3 lie in and the vertical plane along the direction of left-right or the vertical plane along the direction of front-rear where the center line of the shell 1 lies in; or that is to say, the vertical plane where the axis of the first automatic washing system 2 and the second automatic washing system 3 lie in is not parallel with the front wall of the shell, or not parallel with the back wall of the shell; or that is to say the axis of one or more sets of the automatic washing system deviate from the vertical plane along the left-right direction where the center line lies in and locates in front of the vertical plane along the left-right direction where the center line lies in or at the back of the vertical plane along the left-right direction where the center line lies in. Due to the fact that both of the automatic washing systems are in a shape of cylinder and the distance between the first washing system and the second washing system is bounded within a certain range, not too much space requirement of the first automatic washing system and the second automatic washing system in the left-right direction, and the arrangement above could further reduce the length along the left-right direction of the first automatic washing system and the second automatic washing system, and hence further reduce the overall size of the shell and space occupied, additionally make the displacement of the axis of the first automatic washing system and the axis of the second automatic washing system more compact.

In some illustrative embodiments, the included angle forms by the vertical plane where the axis of the first automatic washing system and the axis of the second automatic washing system lie in and the vertical plane where the center line of the top of the shell lies in is in the range of 10° to 20°.

The first automatic washing system and the second automatic washing system are fully automatic washing systems, wherein the washing capacity of the first automatic washing system 2 is greater than that of the second automatic washing system 3, that is to say, two washing systems with different washing capacities. The second automatic washing system 3 could be used to wash small items or only merely a few of clothes. Because two sets of automatic washing systems have different washing capacities, the space occupied by the two sets of automatic washing systems are different, that is to say, the first washing area 4 is larger than the second washing area 5. In order to make better use of the space in the shell 1, the shell 1 further has an auxiliary functional area 6 adjacent to the first washing area 4 and the second washing area 5. It is a reasonable arrangement to set the auxiliary functional area 6 in the shell 1 because the inner space of the shell could be better utilized in this way.

In some illustrative embodiments, a water supply system and a drainage system of the washing machine is used by the first automatic washing system 2 and the second automatic washing system 3 together. Only one set of water supply system and drainage system could reduce parts used in the washing machine and save the inner space of the shell 1, and reduce the cost in material.

In some illustrative embodiments, the outer cylinder of the automatic washing system may shake violently when it enters the spinning cycle. In order to prevent collusion of the two automatic washing systems, a control system is provided in the washing machine of the present invention, the control system sets the two automatic washing systems entering into spinning cycle at different time; for example, a delay is set for one of the automatic washing system upon responding to the setting time for spinning.

In some illustrative embodiments, the auxiliary functional area 6 is configured as a storage module, and to be specific, a storage cabinet is disposed at the auxiliary functional area 6 for placing detergents and it is convenient for the user. A health module may also be arranged in the auxiliary functional area 6, for example, a sterilization and disinfection module to sanitize or disinfect washed clothes. In addition, the auxiliary functional area 6 may also be provided with a third automatic washing system. The washing capacity of the third automatic washing system may be equal to or smaller than the washing capacity of the second automatic washing system, so that sorting washing could be performed in a more dedicate way, such as the third automatic washing system is tailored to wash baby's clothes and adult's underwear.

In some illustrative embodiments, the auxiliary functional area 6 is disposed adjacent to the second washing area 5 in the front-to-back direction, and adjacent to the first washing area 4 in the left-to-right direction, that is to say, the auxiliary functional area 6 is half-surrounded by the first washing area 4 and the second washing area 5, or namely the length of the auxiliary functional area 6 and the second washing area 5 from front to back is equal to the length of the first washing area 4 from front to back. Specifically, in the shell 1, the left side is the first washing area 4, the right back side is the second washing area 5, and the right front side is the auxiliary functional area 6. The front-rear position of the second washing area 5 and the auxiliary functional area 6 also could be switched over, or the first washing area 4 may be disposed at the right side inside the shell.

The structure of each part of the washing machine in this embodiment will be described in detail below. It should be understood that the structure of each part of the washing machine is not limited by the following embodiments.

Figure 4:
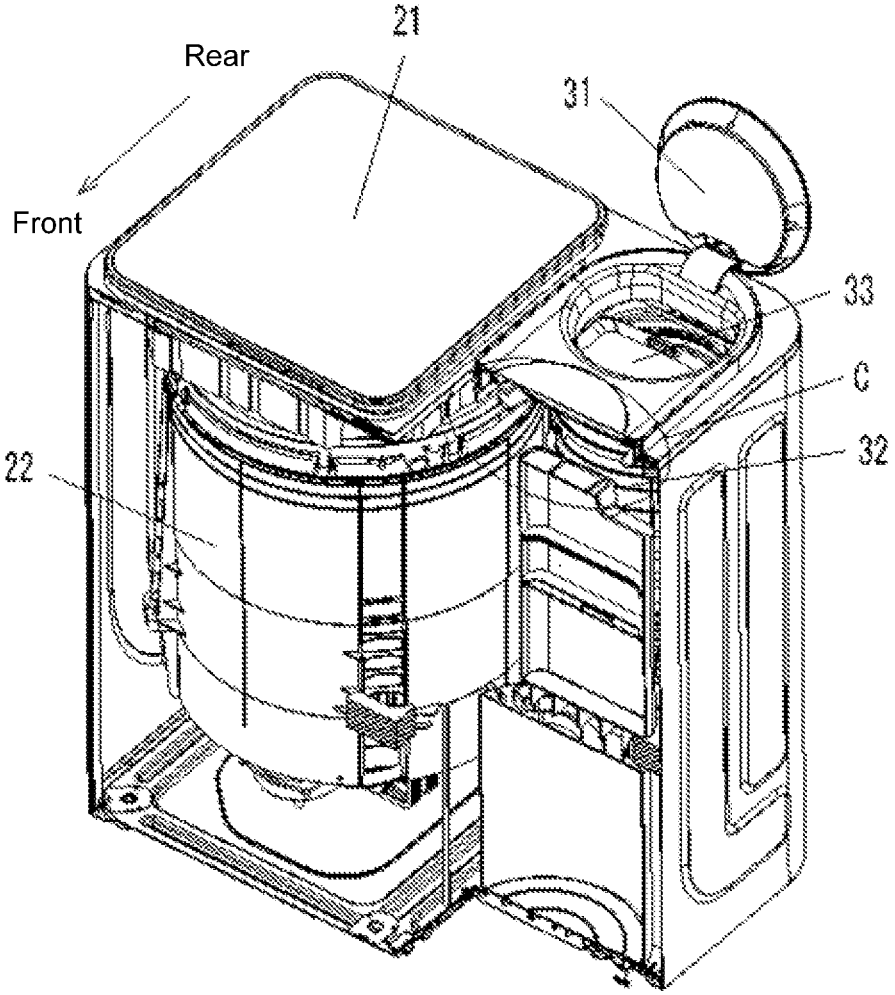
FIG. 4 is a schematic cross-sectional structure in FIG. 1.
Figure 5:
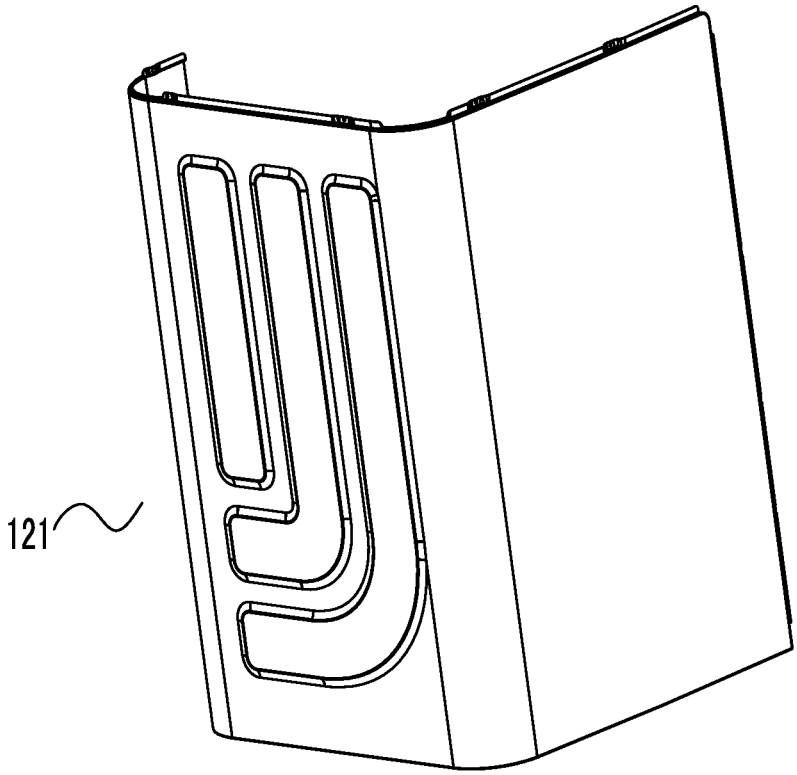
FIG. 5 is a schematic structural view of the left plate in FIG. 3.

Referring to FIG. 2 to FIG. 4, the first automatic washing system 2 and the second automatic washing system 3 arranged in the shell 1 are both fully automatic pulsator-type washing systems. The left side of the shell 1 is the first washing area 4, and the right rear side of the shell is the second washing area 5 and the right front side of the shell is the auxiliary functional area 6. The auxiliary functional area 6 is provided with the storage cabinet. In consideration of the appearance, the auxiliary functional area 6 is designed in an arc-like shape, that is to say, the shell 1 is curved at the front right corner. A first upper cover 21 for opening and closing the laundry input access of the first automatic washing system 2 is provided on the top of the first washing area 4. A second upper cover 31 for opening and closing clothes input port of the second automatic washing system 3 is provided on the top of the second washing area 5. That is to say, the top of the shell 1 is provided with the first upper cover 21 and the second upper cover 31. Considering the appearance and convenience, the display operation module 7 of two sets of automatic washing systems is designed as a whole and disposed on the top of the auxiliary functional area 6. Separate buttons and touch-screen options for two automatic washing systems are arranged on the display operation module 7. The display operation module 7 respectively is electrically connects to a first control module controlling the first automatic washing system 2 and to a second control module controlling the first automatic washing system 3. The arrangement of the display operation module 7 on the top of the auxiliary functional area 6 is concise in appearance, easy for operation and low in manufacturing cost.

Both of the first automatic washing system 2 and the second automatic washing system 3 are fully automatic pulsator-type washing system. The first automatic washing system 2 has a first outer cylinder 22 and the second automatic washing system 3 has a second outer cylinder 32. The outer cylinder takes up a large part of the inner space of the washing machine, therefore the size of the shell is determined if the value of the outer diameter of each of the outer cylinders is known. In order to make the arrangement inside the shell 1 compact, as well as make the overall size of the washing machine smaller, as well as maintain a sufficient space between the first outer cylinder 22 and the second outer cylinder 32 to avoid collision, as well as wearing or damage caused by collision owing to that the automatic outer cylinders vibrate in wash cycle, especially in spinning cycle. In this embodiment, a minimum distance between the first outer cylinder and the second outer cylinder is 15 mm to 30 mm, and preferably 25 mm. Such a comparatively small distance is relied on the enhanced stability of the outer cylinder when the automatic washing system is working, and also on the control method to enable the two outer cylinders to enter into the spinning cycle at different setting time. For example, the outer cylinders vibrates violently at the beginning of the spinning cycle, the control system controls the first automatic washing system and the second automatic washing system, if both of the automatic washing systems are at working and response to the setting time of spinning at the same time, the control system will allow one of them to enter into the spinning cycle at first, and then delay 2 to 3 seconds to allow the other one to enter into the spinning cycle. The user is oblivious to the delay and it does not have impact on user experience.

Both of the first outer cylinder 22 and the second outer cylinder 32 are cylinder-shaped with a determined minimum distance between each other, in order to make the inner space more compact, the second outer cylinder 32 is disposed at the corner of the first outer cylinder 22, namely an included angle formed by the vertical plane where both of the axis of the first outer cylinder 22 and the axis of the second outer cylinder 32 lie in and the vertical plane where the center line of the top of the washing machine; or that is to say, an included angle formed by the vertical plane where both of the axis of the first outer cylinder 22 and the axis of the second outer cylinder 32 lie in and the vertical plane along the left-right direction where the center line of the shell 1 in, or that is to say, the left side in the shell 1 is the first washing area 4, the right rear side in the shell 1 is the second washing area 5, and the right front side in the shell 1 is the auxiliary functional area 6. The second outer cylinder 32 is moved rearward and leftward so that the length along the left-right direction of the shell 1 is reduced; and the washing capacity of the first automatic washing system 2 is comparatively increased and the outer diameter of the first outer cylinder 22 is increased, therefore the front-rear length of the shell 1 could be maintained with a larger auxiliary functional area 6, therefore it is easy for using.

The included angle formed by the vertical plane where the axis of the first outer cylinder and the axis of the second outer cylinder lie in and the vertical plane where the center line of the top of the washing machine lies in is determined by the ratio of the outer diameter of the first outer cylinder 22 to the diameter of the second outer cylinder 32, or determined by the ratio of the washing capacity of the first automatic washing system to the washing capacity of the second automatic washing system, the included angle formed by the vertical plane where the axis of the first outer cylinder and the axis of the second outer cylinder lie in and the vertical plane where the center line of the top of the washing machine lies in is preferably in the range of 10° to 20°, to be specific is 13° or 16°.

Referring to FIG. 2 to FIG. 6, the structure of the shell 1 is disclosed. The shell 1 bears the first automatic washing system 2 and the second automatic washing system 3, that is to say, the first outer cylinder 22 and the second outer cylinder 32 hang in the shell 1 by suspensions. The shell 1 is provided with a frame 11 to increase its strength. The frame 11 is covered by the shell body 12. The frame 11 and the shell body 12 are fastened with screws to enable the frame 11 and the shell body 12 to be as a whole with great rigidity. The modal vibration frequency of the shell 1 can reach 18.9 Hz. The shell could sufficiently withstand the longitudinal and transverse torsion forces produced in the spinning cycle. To be specific, the upper portion between the frame 11 and the shell body 12 are arranged eight screws and the lower portion between the frame 11 and the shell body 12 are arranged fifteen screws, both ends of each of the fillet and each of the arc portion is fastened with a screw.

The frame 11 includes an upper frame 111 and a base 112. A plane where the upper frame 111 is in is parallel to a plane where the base 112 is in. The frame 11 further includes a plurality of vertical beams 113 disposed between the upper frame 111 and the base 112. A horizontal beam 116 is disposed on partial vertical beams 113 for increasing the overall strength of the frame 11. The upper frame 111 is provided with an upper middle beam 1110 in the front-rear direction. A middle bottom beam 1120 in the front-rear direction is arranged on the base 112. The vertical plane where the upper middle beam 1110 and the bottom middle beam 1120 lie in divides the space enclosed by the shell 1 into a left part and a right part, the first washing area 4 is on the left side, the second washing area 5 and the auxiliary functional area 6 are on the right side. The shell 11 provided with a frame 11 enhances the strength of the shell to carry the first automatic washing system 2 and the second automatic washing system 3, and make the shell 1 more solid. The upper middle beam 1110 and the bottom middle beam 1120 also divide the shell 1 into the left area and right area, shown in the FIG. 6.

The shell body 12 includes a left plate 121, a right plate 122, and a back plate. The left plate 121 is bent to form a front plate, a left side plate and a part of the back plate. The right plate 122 is bent to form a right side plate and a part of the back plate. A storage door 124 to open or close the storage cabinet in the auxiliary functional area 6 is arranged between the left plate 121 and the right plate 122 on the front of the shell, and the cross section of the storage door 124 is arch-shaped. According to the displacement, the overall of the shell 1 is concise in appearance and strong in strength. L-shaped stiffeners are pressed on the left plate and on the right plate that could avoid the problem of linear penetration between groove areas on straight type stiffeners which breaks up the plate's buckling inertia axis, and increase the overall strength of the shell, shown in FIG. 3 and FIG. 5.

Figure 6:
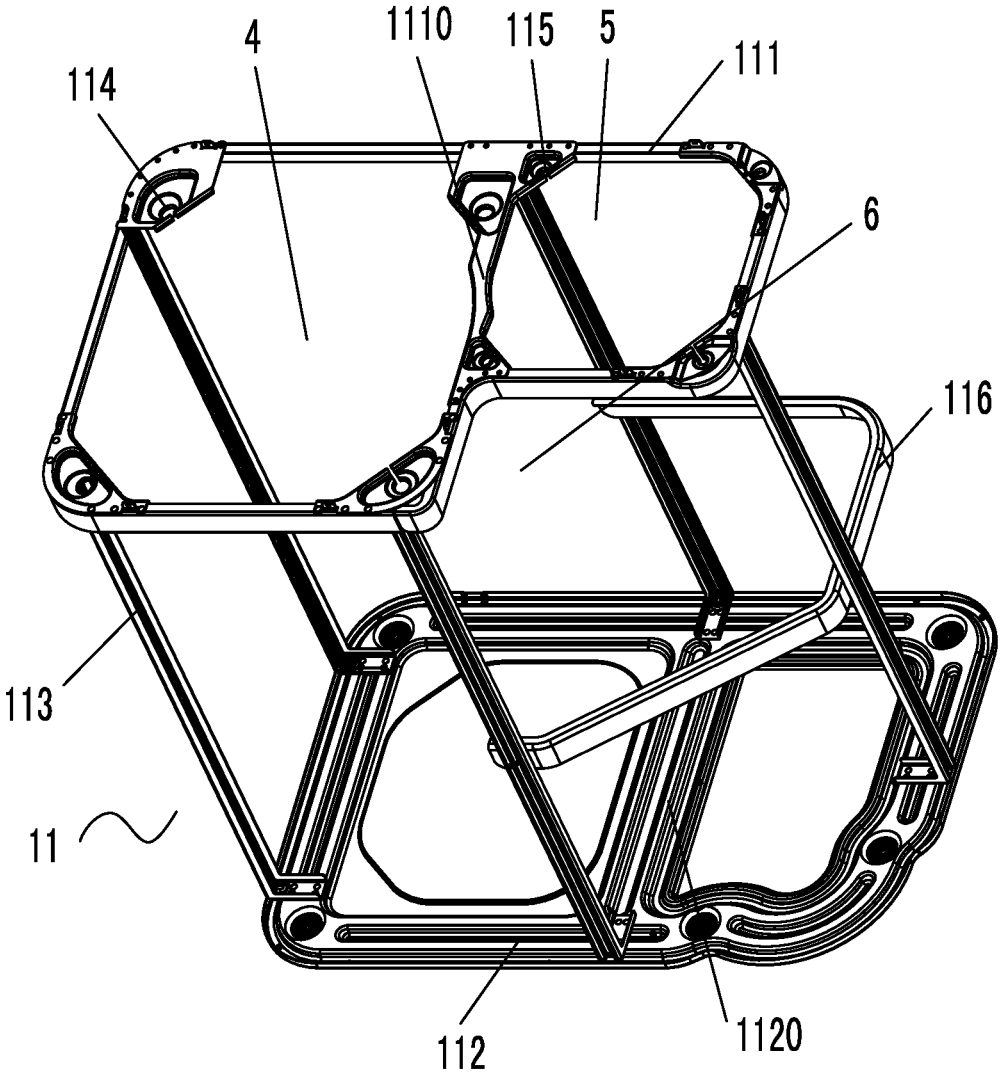
FIG. 6 is a schematic view of a specific embodiment of the frame in FIG. 3.
Figure 7:
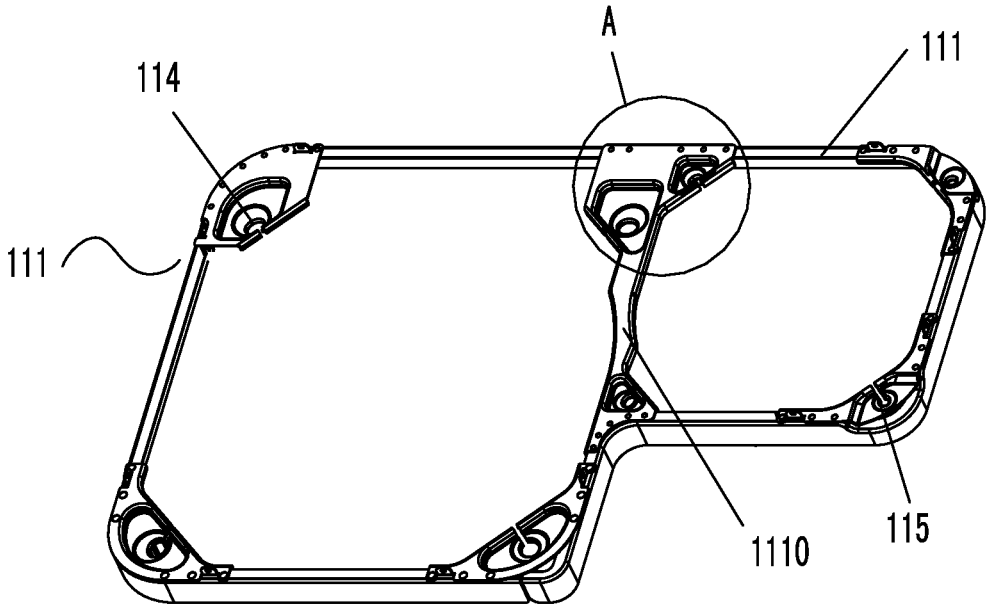
FIG. 7 is an enlarged schematic view of the upper frame in FIG. 6.

Shown in the FIG. 6 and FIG. 7 is a detailed embodiment of the frame 11. The upper frame 111 of the frame 11 includes a large square frame where the first washing area 4 is in and a small square frame where the second washing area 5 is in. The upper middle beam 1110 is a public edge of the large square frame and the small square frame. The first automatic washing system 2 and the second automatic washing system 3 are fully automatic pulsator-type washing systems. The first outer cylinder 22 of the first automatic washing system 2 is hung in the large square frame of the upper frame 11 at its four corners by four suspensions, and the second outer cylinder 32 of the second automatic washing system 2 is hung in the small square frame of the upper frame 11 at its four corners by four suspensions. In order to increase the supporting force and the strength of the suspending joints, a first hanging structure 114 is provided at each of the four corners of the large square frame of the upper frame 111 and a second hanging structure 115 is provided at each of the four corners of the small square frame of the upper frame 111. The upper middle beam 1110 is a public edge of the large square frame and the small square frame, and is used for holding the suspension of the first outer cylinder 22 and the suspensions of the second outer cylinder 32, that is to say, the upper middle beam 1110 is provided with the first hanging structure 114 for carrying the first automatic washing system 2 and the second hanging structure 115 for carrying the second automatic washing system 3, and the upper middle beam 1110, the first hanging structure 114 and the second hanging structure 115 are in one piece formed as a whole. The one-piece structure also could increase the overall strength of the structure. In the present embodiment, the upper middle beam 1110 is made of steel sheet and formed by press, and in other circumstance, the upper middle beam 1110 also can be manufactured by plastic material by integrally injection molding with sufficient material strength.

Figure 8:
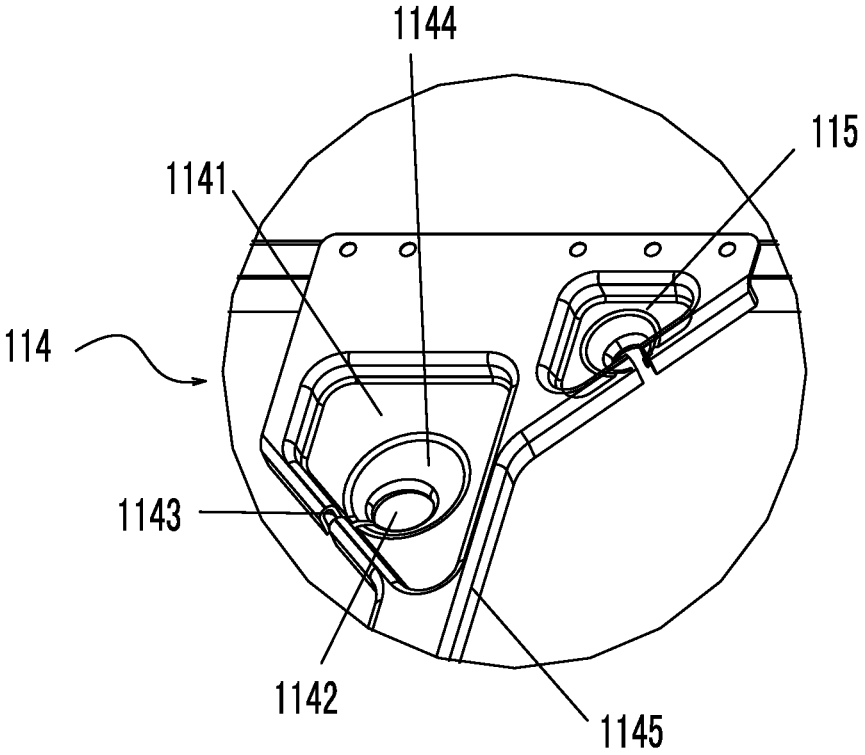
FIG. 8 is an enlarged schematic view of the region A in FIG. 7.

The suspension includes a suspending rod, a seat arranged at the upper portion of the suspending rod, and a damping member at the lower portion of the suspending rod. As shown in FIG. 8, the first hanging structure 114 has a concave receiving portion 1141 for receiving the seat of the suspension, and a convex working hole 1142 is opened at the bottom of the concave receiving portion 1141, and the suspending rod is hung in the working hole 1142. To be specific, the first hanging structure 114 is provided with a channel 1143 through which the suspending rod enters into or exits from the working hole 1142, and the suspending rod hangs in the working hole 1142 though the channel 1143. The concave receiving portion 141 increases the strength of the first hanging structure 114 and the stability after the suspension is being installed. In order to further increase the contact area between the first hanging structure 114 and the suspension, that is to say, the contact area between the working hole 1142 and the base, the working hole 1142 is connected to the bottom of the concave receiving portion 1141 through the funnel-shaped working surface 1144. The funnel-shaped working surface 1144 attaches to the base of the suspension. By providing the funnel-shaped working surface 1144, the contact area between the working hole 1142 and the base is increased so that the bearing force per unit area at the working hole 1142 is reduced, the ability to withstand stress of the first hanging structure 114 is improved and the stability of the suspension is enhanced. A downward flange 1145 is further disposed inside the first hanging structure 114 to further enhance the strength of the first hanging structure 114. The second hanging structure 1115 is also provided in the same structure as the first hanging structure 114.

Figure 9:
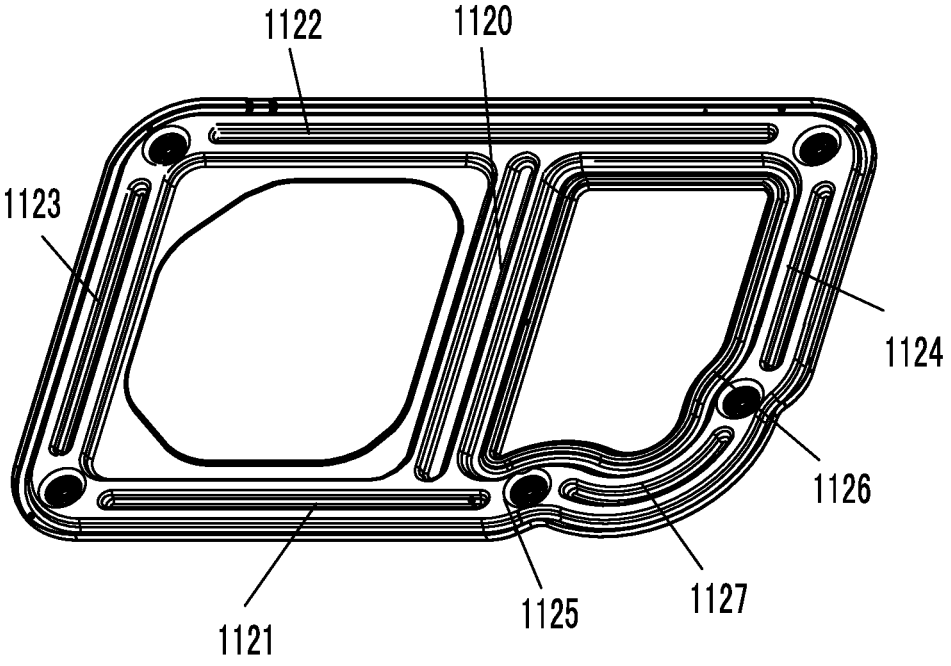
FIG. 9 is a schematic enlarged view of the base station in FIG. 6.

The front right corner of the shell 1 is arc-like shaped, that is to say, the storage door 124 is arc-like shaped, the front right corner of the base 112 is also designed in an arc-like shape to enhance the support of the base 112 to the storage cabinet at the auxiliary functional area 6, as well as increase the overall strength of the base 112. As shown in FIG. 9, the base 112 includes a large square area where the first washing area 4 is in and a small square area where the second washing area 5 is in, and a corner area where the auxiliary functional area is in. Specifically, the base 112 includes a bottom front beam 1121 and a bottom rear beam 1122 parallel to each other, and a left bottom beam 1123, a bottom center beam 1120 and a right bottom beam 1124 that are parallel to each other. The bottom front beam 1121, the bottom rear beam 1122, the left bottom beam 1123 and the bottom center beam 1120 enclose the large square area where the first washing area 4 is in, and the bottom back beam 1122, the bottom center beam 1120 and the right side bottom beam 1124 enclose the small square area where the second washing area 5 is in. The front bottom beam 1121 and the right bottom beam 1124 extend towards each other to form a front bottom extending beam 1125 and a side bottom extending beam 1126 respectively, and an arc-shaped beam 1127 is disposed between the front bottom extending beam 1125 and the side bottom extending beam 1126. The bottom extending beam 1125, the side bottom extending beam 1126 and the arc-shaped beam 1127 form a corner bottom beam in the corner area. The front bottom extending beam 1125 and the side bottom extending beam 1126 increase the strength at the corner bottom beam, and the center angle of the arc-shaped beam 1127 is comparatively large. Preferably, the center angle of the arc-shaped beam 1127 is 100° to 120°. The arc degree of the arc-shaped beam 1127 is equal to the arc degree of the storage door 124, or the center of the arc-shaped beam 1127 is on the center line of the storage door 124. In order to further increase the strength of the base 112, the base 112 is integrally formed by press with convex shaped stiffeners on each of the beams of the base 112, that is to say, convex shaped stiffeners extend downwards are pressed on the bottom front beam 1121, the bottom rear beam 1122, the left bottom beam 1123, the bottom beam 1120, the right bottom beam 1124 and the arc-shaped beam 1127 to increase the height of the base 112 strength.

In order to dispose the washing machine on the ground, it is necessary to install feet on the bottom of the base 112. In this embodiment, a total of five feet are mounted on the base 112, of which three are fixed feet and two are movable feet. Fixed feet are provided on the front and rear corners and the right rear corner of the left side of the base 112, and movable feet are respectively arranged at the connection between the arc-shaped beam 1127 and the front bottom extending beam 1125 and at the connection between the arc-shaped beam 1127 and the side bottom extending beam 1126. These arrangements could support the washing machine in a better way. In addition, by setting two movable feet, the washing machine can be positioned at the leveling point more easily.

Five vertical beams 113 are vertically arranged between the upper frame 111 and the base 112, one vertical beam 113 is respectively arranged at the front and the rear of the left lower beam 1123 of the frame 11, one vertical beam is arranged at the front and the rear of the lower beam 1120 respectively, and the right side of the bottom beam 1124 is also provided with a vertical beam 113. The distance between the two vertical beams 113 on the left side is smaller than the front and back distances of the frame 11, that is to say, the two vertical beams 113 are disposed in close proximity to the front and rear ends of the left bottom beam 1123. The data obtained through testing shows that the overall stability and strength of the shell under the condition that the two vertical beams 113 are disposed in close proximity to the front and rear ends of the left bottom beam 1123 are better than the overall stability of the shell under the condition that the two vertical beams 113 are disposed at the position where the front and rear ends of the left bottom beam 1123 are, as shown in FIG. 6.

Figure 10:
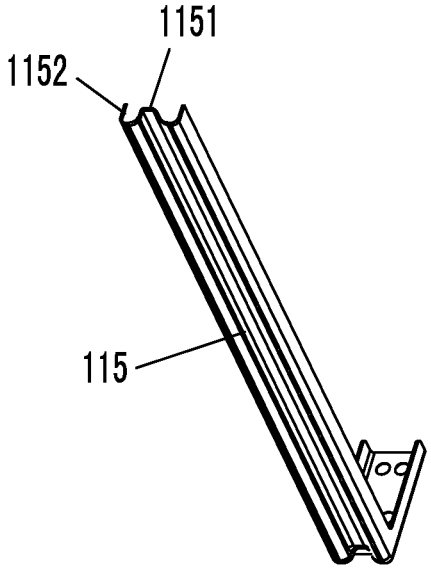
FIG. 10 is a schematic enlarged view of a section of the cross-sectional surface of the vertical beam in FIG. 6.

In order to further increase the strength of the vertical beam, the vertical beam 113 is designed as a wave-shaped plate, and the vertical beam 113 has an approximate "M" shape in cross section. The cross-section of the vertical beam 113 has an extension portion 1152, wherein the middle of the extension portion provided with an inwardly protruding wave-like shape 1151 and each of the two ends has an inward flange. The two extension portions 1152 are parallel to each other, and the position of the center of the shell 1 is defined as the direction of inner. Such structure increases the structural strength of the vertical beam but also stabilizes the structure that the vertical beam 113 and the shell body 12 are assembled, as shown in FIG. 10. After the vertical beam 113 is assembled with the shell body 12, the inwardly protruding sides of the vertical beam 113 are in contact with the shell body 12 at the same time, so as to increase the overall strength after assembly.

Figure 11:
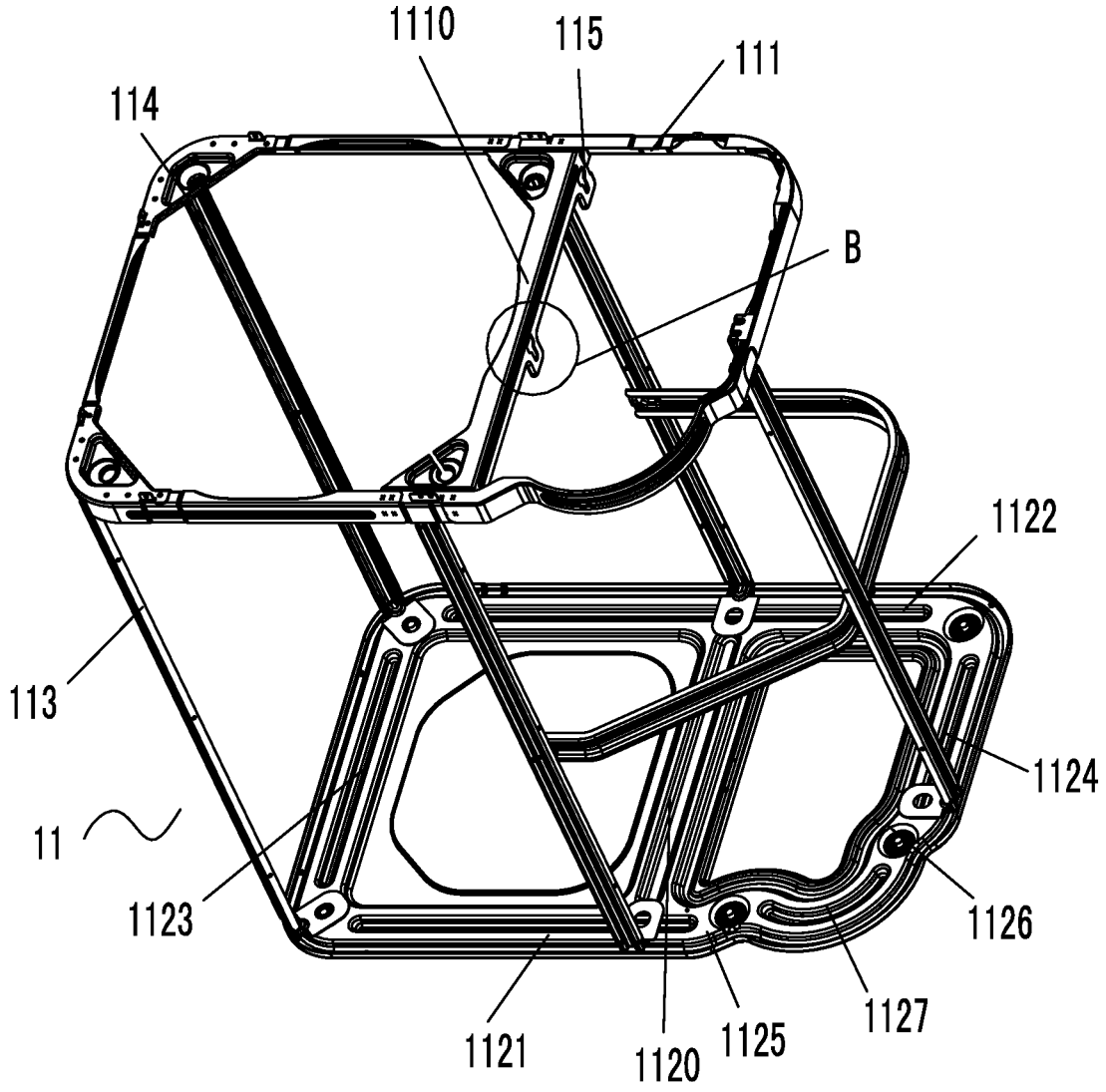
FIG. 11 is a schematic view of another embodiment of the frame in FIG. 3.
Figure 12:
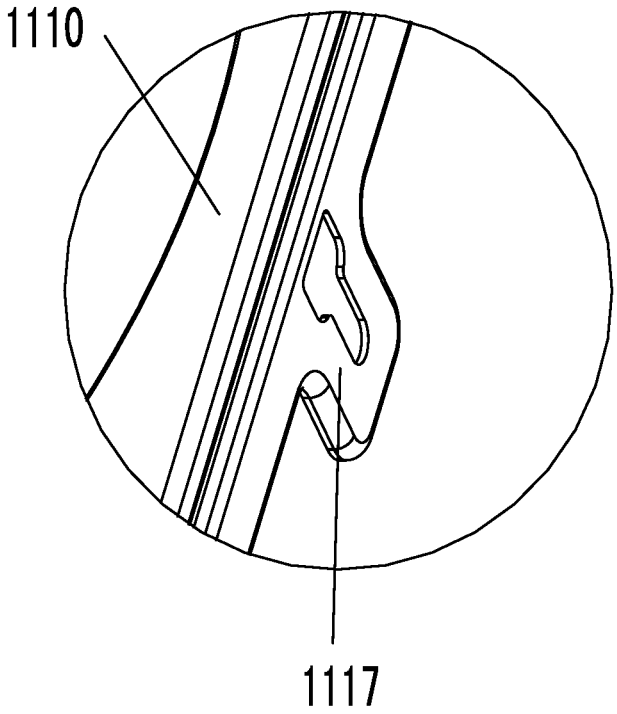
FIG. 12 is a schematic enlarged view of the B region in FIG. 11.

Referring to FIG. 11 and FIG. 12, another specific embodiment of the frame 11 will be described. The main feature of the frame is the upper frame. Other structures are as same as the first embodiment. The base 112 of the frame 11 has the same structure as described above. The base 112 has a bottom front beam 1121 and a bottom rear beam 1122 which are parallel to each other, and a left bottom beam 1123, a bottom center beam 1120 and a right side bottom beam 1124 which are parallel to each other; the bottom front beam 1121, the bottom back beam 1122, the left bottom beam 1123 and the bottom center beam 1120 encloses the large square area where the first washing area is in; the bottom rear beam 1122, the bottom center beam 1120, and the right side bottom beam 1124 encloses the small square area where the second washing area 5 is located. The front bottom beam 1121 and the right bottom beam 1124 extend towards each other to form a front bottom extending beam 1125 and a side bottom extending beam 1126 respectively, and an arc-shaped beam 1127 is disposed between the front bottom extending beam 1125 and the side bottom extending beam 1126. The bottom extending beam 1125, the side bottom extending beam 1126 and the arc-shaped beam 1127 form a corner bottom beam in the corner area. The upper frame 111 has the same structure as the base 112. A corner upper beam is also provided at the front right rear portion of the upper frame 111. The structure of the corner upper beam and the lower corner beam are same to increase the overall strength of the frame 1. The left side of the upper frame 111 is a large square frame where the first washing area 4 is in, and the four corners of the large square frame are provided with the first hanging structure of the same structure as the above. The second hanging structure 1115 is disposed at the four corners of the right rear square area of the upper frame 111. Due to the smaller washing capacity of the second automatic washing system, the second hanging structure 1115 withstands less suspension force. Therefore, the second hanging structure 1115 is designed as a vertical mounting ear 1117, and a through hole is formed in the mounting ear.

Figure 13:
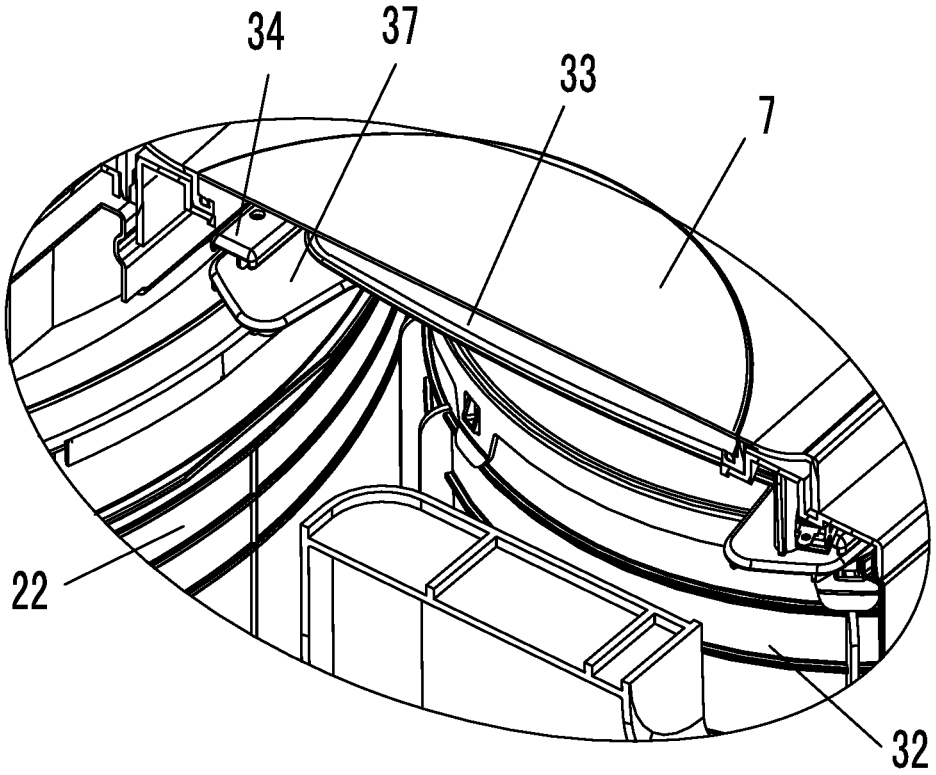
FIG. 13 is an enlarged schematic view of the C region in FIG. 4.

Referring to FIG. 4, FIG. 13 to FIG. 25, the inner cover of the second automatic washing system 3 will be described. First, the direction of inner-outer indicates the direction from the position near the center of the second outer cylinder to the position away from the center of the second outer cylinder. The second outer cylinder 32 of the second automatic washing system 3 has an outer cylinder cover 321, and a clothes access 3211 for putting in laundry is disposed on the top of the outer cylinder cover 321. In this embodiment, the second automatic washing system 3 has a heating function. In order to avoid the leakage of water vapor in wash cycle, and also prevent the laundry in the inner cylinder from being thrown out during the high-speed operation, the outer cylinder cover 321 is provided with a removable inner cover 33 and the inner cover 33 slides to open or close the clothes access 3211. It is defined that the inner cover 33 has a closing position where the clothes access 3211 is being closed and an opening position where the clothes access 3211 is being opened. A receiving area which accommodates the inner cover 33 when the inner cover 33 horizontally slides from the closing position to the opening position is provided. By means of the receiving area in the shell 1, the sliding inner cover 33 could be arranged on the outer cylinder cover 321, which avoids problems caused by traditional turnover cover, such as unaesthetic design due to reinforcing ribs below the inner cover, occupied space and tangling clothes when taken out and the like. Referring to FIG. 4 and FIG. 13, the inner cover 33 is arranged to slide in the front-rear direction. When the inner cover 33 slides forwards, the clothing access 3211 is opened, and the inner cover 33 slides to the receiving area reserved above the storing cabinet, that is to say, the receiving area occupies a part of the room on the upper side of the auxiliary functional area 6 inside the shell 1 so that the storage cabinet is arranged in the space of the auxiliary functional area 6 below the receiving area.

Figure 16:
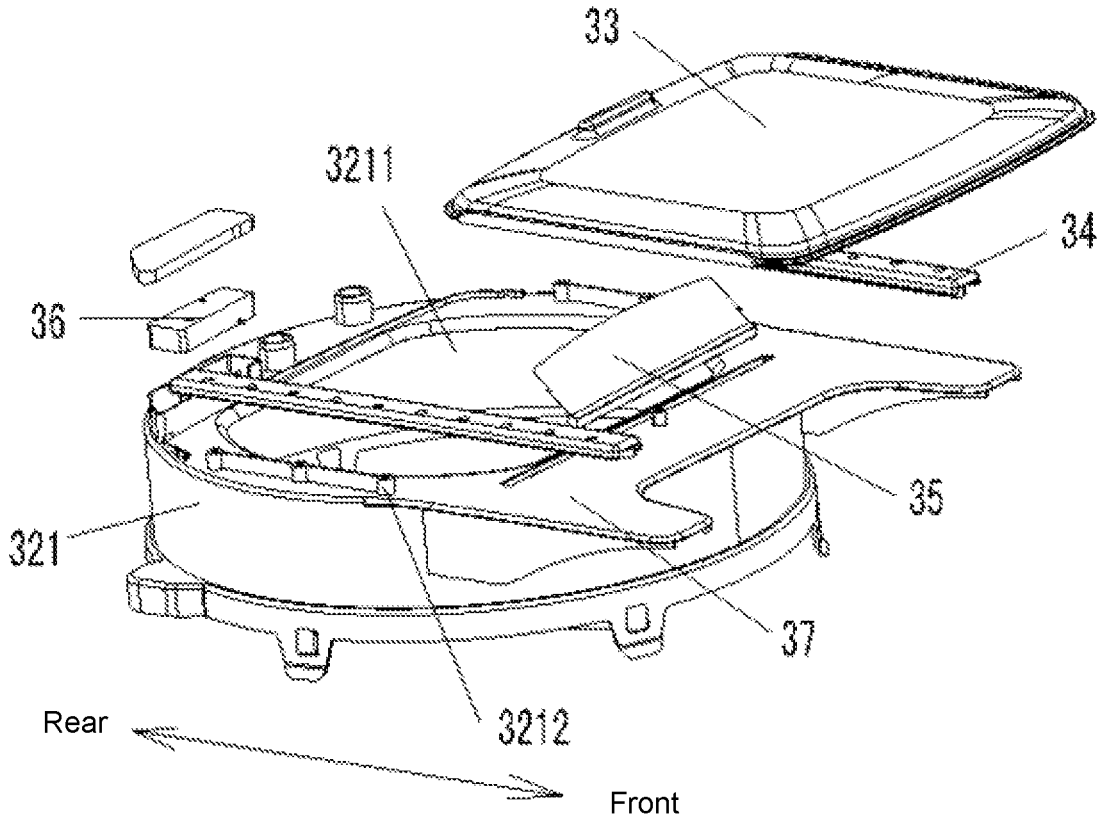
FIG. 16 is a schematic enlarged view of the outer cylinder cover in FIG. 14.
Figure 17:
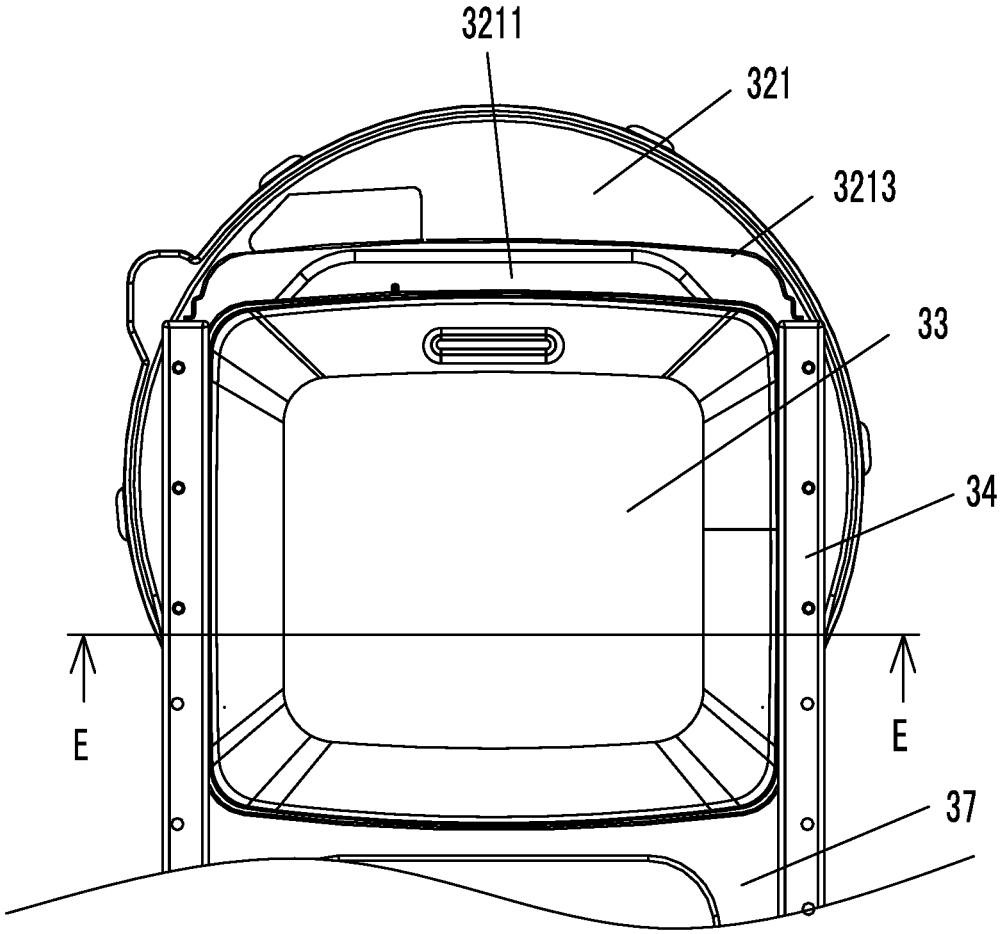
FIG. 17 is a schematic plan view of the structure in FIG. 16 after installation.

The inner cover 33 is an integral inner cover to make the structure simple and the overall strength great. Two parallel pressing pieces 34 are disposed on the outer cylinder cover 321 on both of the left and right sides of the clothes access 3211, the pressing pieces 34 are arranged in the direction of back and forth, and a sliding trail sliding the inner cover 33 is formed between the pressing piece 34 and the outer cylinder cover 321; the left and right ends of the inner cover 33 extend outwardly to form horizontal sliding pieces 331. The sliding piece 331 slides back and forth in the sliding trail, so that the inner cover 33 opens or closes the clothes access 3211, as shown in FIG. 16 to FIG. 17.

Figure 18:
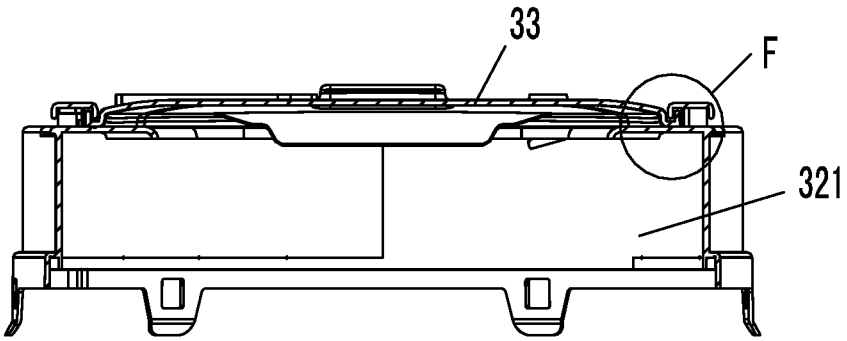
FIG. 18 is a schematic sectional view of the FIG. 17 along the line E-E.
Figure 19:
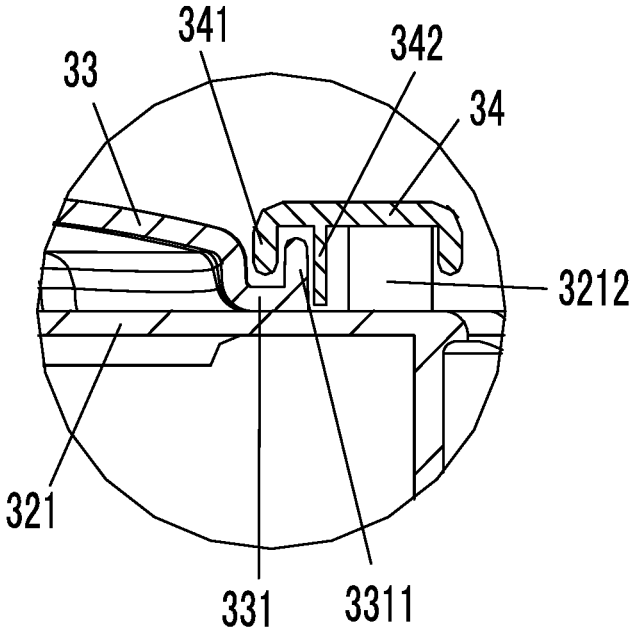
FIG. 19 is an enlarged schematic view of the F region in FIG. 18.

In order to further increase the tightness between the inner cover 33 and the outer cylinder cover 321, the structure of the pressing piece 34 and the sliding piece 331 is provided. The edge of the sliding piece 331 is provided with an upward flange 3311, that is to say, a flat "L" structure is formed when the flange 331 is provided with the upward flange 3311. The inner side of the pressing piece 34 has a downward flange 341, that is to say, a flat "L" structure is formed when the pressing piece 34 is provided with the downward flange 341, and the two "L" structures engages with each other, or that is to say the upward flange 3311 located outside of the downward flange 341. By arranging the pressing piece 34 and the sliding piece 331 engaged with each other, the connection between the inner cover 33 and the pressing piece 34 is more compact, the stability when the inner cover 33 slides back and forth is ensured, and at the same time, when the inner cover 33 is in the closing position, the water vapor in the second washing cylinder 32 is not easily leaked through the sliding piece 331. In order to further prevent leakage of water vapor from the gap between the inner cover 33 and the outer cylinder cover 321 when the second automatic washing system enters into heat cycle, a vertical downward baffle 342 is further disposed on the pressing piece 34. The baffle 342 is located outside of the upward flange 3311, that is to say, the upward flange 3311 is located within the space surrounded by the pressing piece 34, the baffle 342, and the downward flange 341. The water vapor in the second washing cylinder 32 leaks from the sliding piece 331 and then is blocked by the baffle plate 342, and therefore the water vapor is further prevented from leaking through the gap between the sliding piece 331 and the outer cylinder cover 321, and meanwhile, the upward flange 3311 can be limited to move back and forth within the space enclosed by the pressing piece 34, the baffle 342 and the downward flange 341, also further improves the stability of sliding, as shown in FIG. 18 to FIG. 19.

There are many ways to mount the pressing piece 34 on the outer cylinder cover 321, such as screwing connection. In this embodiment, a plurality of mounting cylinders 3212 are disposed on the outer cylinder cover 321. Screw holes corresponding to the mounting cylinders 3212 are opened on the pressing pieces 34, and the pressing pieces 34 are fixed to the mounting cylinders 3212 by screws. Preferably, the height of the mounting cylinder 3212 is equal to or slightly larger than the height of the baffle 342. In order to improve the stability after mounting the pressing piece 34, connecting plates connecting adjacent mounting cylinders are arranged between the adjacent mounting cylinders 3212.

The height of the connecting plate is equal to the height of the mounting cylinder 3212. After mounting the pressing piece 34, the lower surface of the pressing piece 34 contacts the upper surface of the mounting cylinder 3212 and the upper surface of the connecting plate so that the connecting plate also serves to support the pressing plate 34 while reinforcing the mounting cylinder 3212, the pressing piece 34 is more stable after installation.

In order to reduce the cost of the inner cover 33, the inner cover 33 is preferred designed to be as thin as possible, but the strength of the inner cover 33 should be ensured in the meanwhile. Therefore, the inner cover 33 is designed to be of an upward arched shape so as to increase the strength of the inner cover 33. The height of the inner cover 33 is gradually increased from the edge to the center. The height of the center of the inner cover 33 corresponding to the outer cylinder cover 321 is the largest. The inner cover 33 is also attached to the outer cylinder cover 32 so as to increase the tightness preventing the leakage of water vapor in the second inner cover 33. The outer periphery of the inner cover 33 is provided with horizontal sealing edges, that is to say, the outer periphery of the arched structure extends outward to form the horizontal sealing edges, and the horizontal sealing edges attach to the outer cylinder cover 321 to ensure that the inner cover 33 is in close contact with the outer cylinder cover 321 in the closing position. The sealing edges of the inner cover 33 are the sliding pieces mentioned above.

In order to further prevent leakage of the water vapor in the second washing cylinder 32, a stopper baffle 3213 is further provided at the rear end of the outer cylinder cover 321. When the inner cover 33 is in the closing position, the rear end of the inner cover 33 attaches to the stopper baffle 3213, referring to FIG. 17.

When the inner cover 33 slides back and forth, the inner cover 33 is locked by the positioning structure provided when the inner cover 33 slides to the closing position to close the clothes access. Specifically, a positioning structure is provided between the inner cover 33 and the outer cylinder cover 321, and the positioning structure includes a positioning cylinder and a slot. In this embodiment, a positioning cylinder 3214 is provided on the upper surface of the front part of the outer cylinder cover 321, and a slot 332 is provided on the lower surface of the inner cover 33. When the inner cover 33 slides rearwards to the closing position for closing the clothes access 3211, the slot 332 on the inner cover 33 just engages with the positioning cylinder 3214 so that the inner cover 33 is prevent from sliding backwards; and the slot 332 engages with the positioning cylinder 3214 so that the inner cover 33 is prevented from moving forwards automatically, shown as in FIG. 15 and FIG. 20.

In other implementations, a slot may be provided on the outer cylinder cover 321, and a mounting cylinder may be disposed on the inner cover 33.

Figure 20:
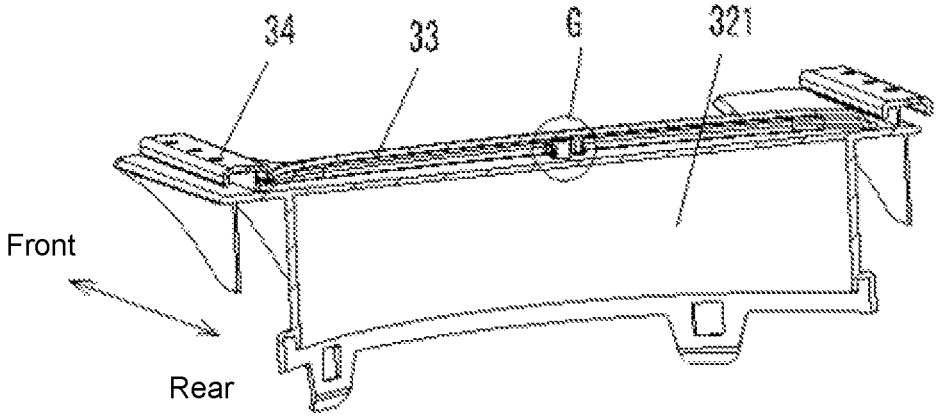
FIG. 20 is a schematic cross-sectional view of the positioning area of the outer cylinder cover in FIG. 16.
Figure 21:
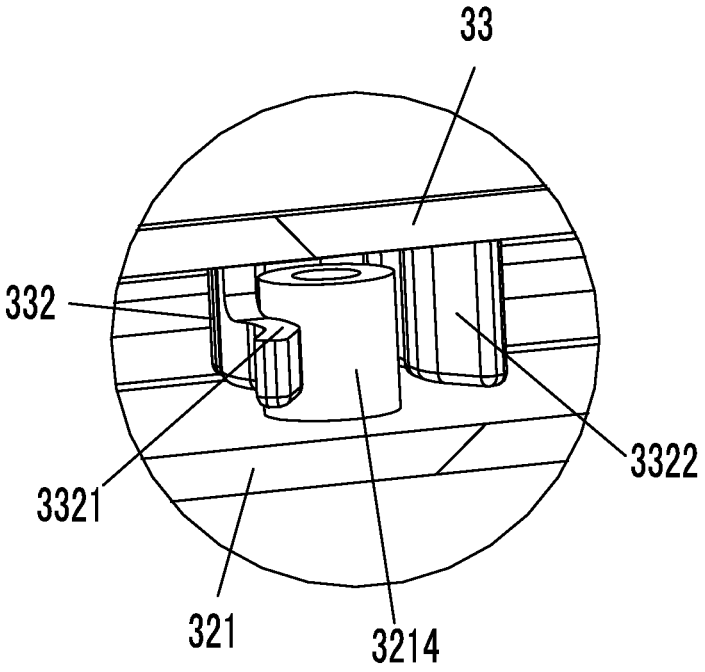
FIG. 21 is a schematic enlarged view of the G region in FIG. 20.
Figure 22:
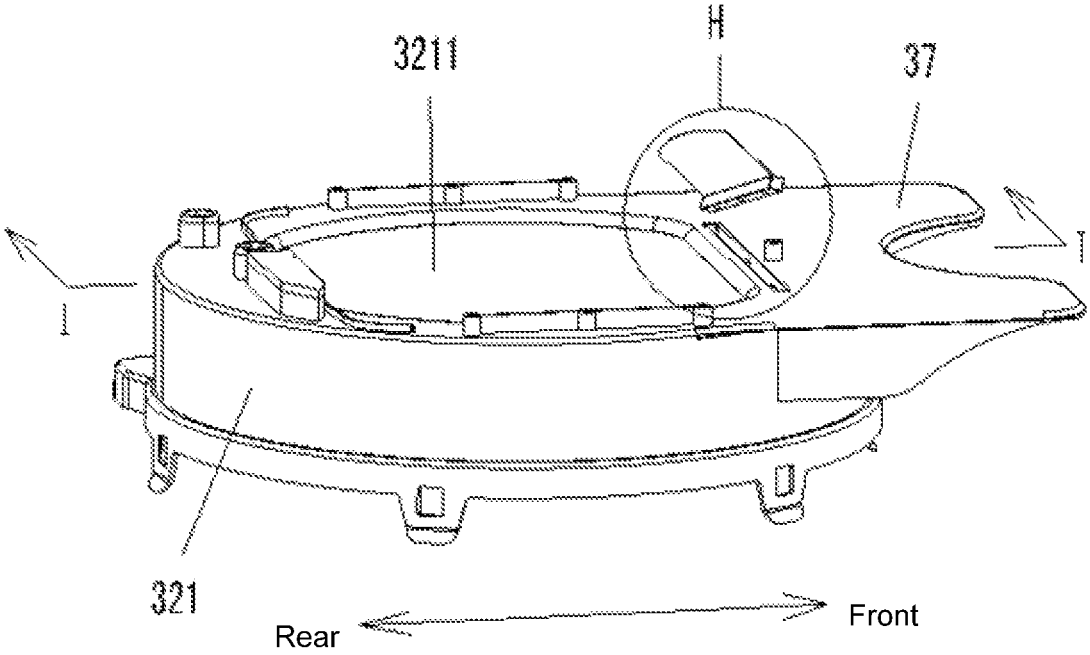
FIG. 22 shows part of the structures in FIG. 16.

Referring to FIG. 20 and FIG. 21, the slot 332 is disposed on the lower surface of the inner cover 33. Since merely the edge of the inner cover 33 is in contact with the outer cylinder cover 321, the other part of inner cover is in an arched shape, the sliding movement of the inner cover does not be blocked by the positioning cylinder 3214 on the outer cylinder cover 321. The slot 332 is a "C" shaped slot and the opening of the shaped slot faces forwards. A flexible claw 3321 inwardly bent is provided at one end of the slot 332. The lower portion of one end of the slot 332 is connected with the claw 3321, that is to say, the height of the claw 3321 is smaller than the height of the slot 332. When the positioning cylinder 3214 is in the slot 332, the claw 3321 engages with the positioning cylinder 3214, so that the positioning cylinder 3214 does not detach from the slot 332. That is to say, when the inner cover 33 is in the closing position, the slot 332 and the positioning cylinder 3214 are locked to ensure that the inner cover 33 is closed even that the second automatic washing system vibrates, shakes or the like during the wash cycle. When the wash cycle is finished, the inner cover 33 needs to be manually pushed forwards to enable the slot 332 detach from the positioning cylinder 3214, and then the inner cover 33 is opened. In order to ensure that the positioning cylinder 3214 is easy to enter the slot 332 as closing the inner cover 33, an outward flange is provided at an end of the claw 3321, and the other end of the slot 332 extends outwards to form a guiding portion 3322. When the inner cover moves backwards to close the clothes access, as the positioning cylinder at the position between the outward flange at the end portion of the claw 3321 and the guiding portion 3322, the positioning cylinder 3214 is guided by the outward flange and the guiding portion 3322 and the positioning cylinder 3214 could easily enter into the slot 332 and be engaged with.

Figure 24:
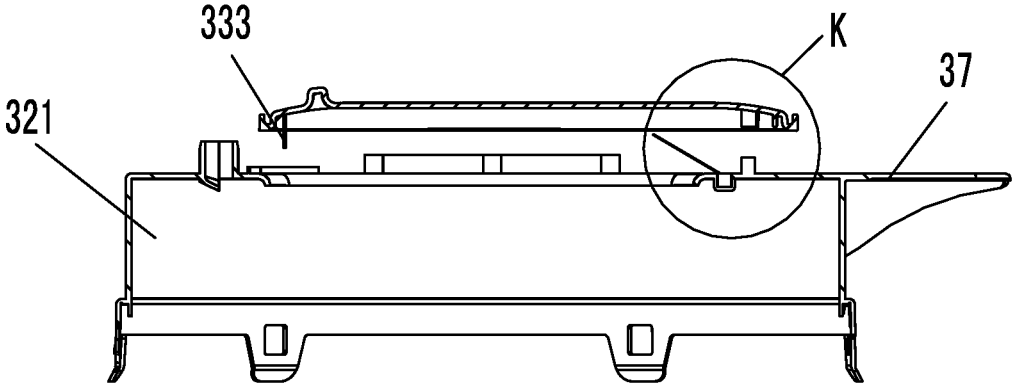
FIG. 24 is a schematic cross-sectional view of the FIG. 22 along the line I-I.

A stopper 333 is further disposed at the rear end of the lower surface of the inner cover 33, when the inner cover 33 slides forwards to open the clothes input access 311, the inner cover 33 begins to enter the receiving area. When the inner cover 33 reaches the open position, the stopper 333 is in contact with the front end of the clothes access 3211, and the inner cover 33 is prevent from moving forward to detach from the outer cylinder cover 321, as shown in FIG. 24.

Figure 14:
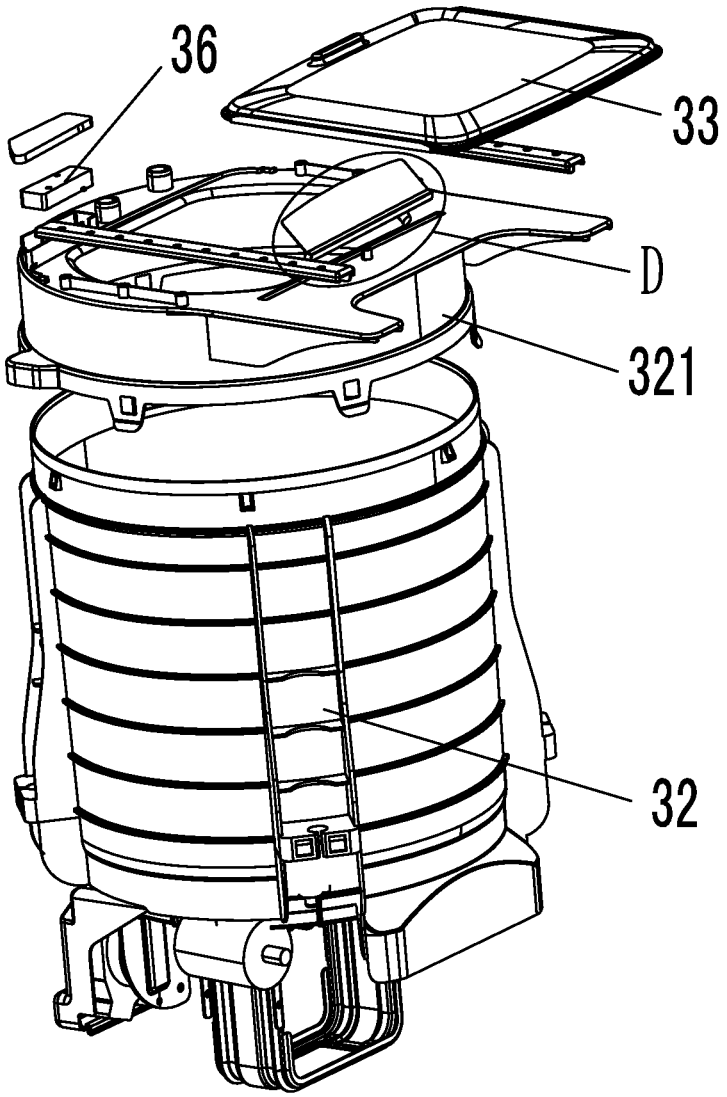
FIG. 14 is an exploded view of the second automatic washing system in FIG. 1.
Figure 15:
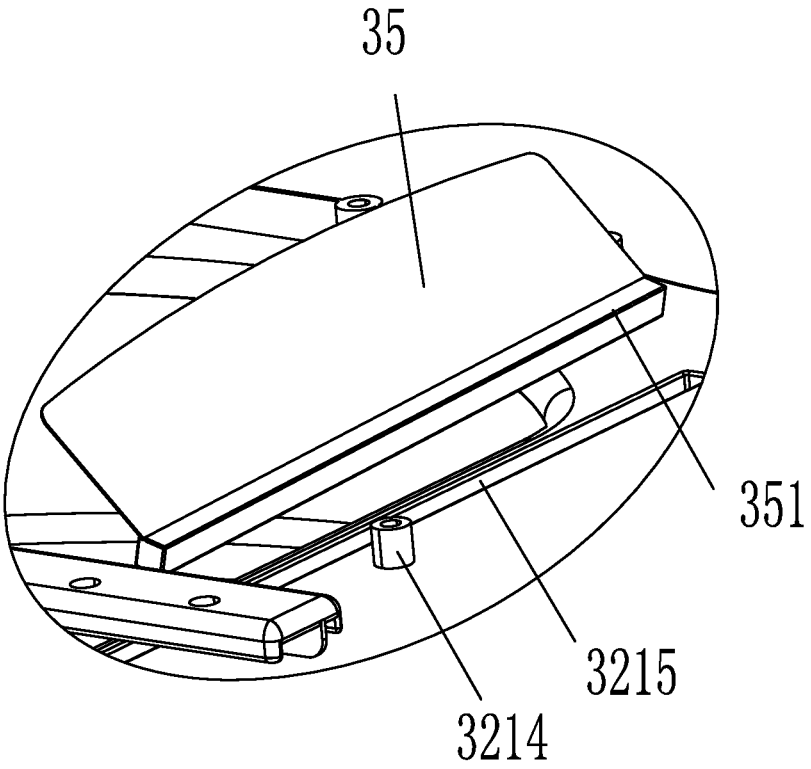
FIG. 15 is an enlarged schematic view of the D region in FIG. 14.

Referring to FIG. 14 and FIG. 16, since the outer cylinder cover 321 and the second outer cylinder 32 have the same outer diameter, when the inner cover 33 is opened, the inner cover 33 moves forwards into the receiving area, and the front portion of the inner cover 33 gradually detaches from the outer cylinder cover 321. In order to hold the inner cover 33 and ensure the horizontal sliding of the inner cover 33 and the tightness between the inner cover 33 and the outer cylinder cover 321, a support plate 37 is provided in front of the outer cylinder cover 321. The upper surface of the support plate 37 and the upper surface of the outer cylinder cover 321 are in the same horizontal plane. When the inner cover 33 is opened, the inner cover 33 slides from the outer cylinder cover 321 towards the support plate 37. In this embodiment, the support plate 37 is of a shape of dovetail, and mainly supports the sliding pieces 331 on the left and right sides of the inner cover 33. By providing the supporting plate 37, the horizontal sliding of the inner cover 33 is ensured, the deformation of the sliding piece 331 caused by the problem that the front of the inner cover 33 is dangled and drooped when the inner cover 33 is opened is avoided, so as to ensure the tightness between the inner cover 33 and the outer cylinder cover 321.

Referring to FIG. 14 to FIG. 16 and FIG. 22 to FIG. 25, the structure of a wiping plate provided on the outer cylinder cover of the second automatic washing system 3 is illustrated. For example, when the second automatic washing system 3 starts to work, the heating function is activated. The water vapor moves upwards and encounters with the closed inner cover 33, and part of the water vapor condenses on the lower surface of the inner cover 33 and becomes water droplets. When the wash cycle is finished, the inner cover 33 is with water droplets. In order to prevent water on the inner cover 33 dropping on the shell 1, the wiping plate 35 is disposed in the front of the outer cylinder cover 321. The wiping plate 35 is in contact with the lower surface of the inner cover. When the inner cover 33 is opened, the wiping plate 35 removes water droplets from the lower surface of the inner cover 33. The arrangement of the wiping plate 35 could avoid water on the lower surface of the inner cover 33 dropping on the outer cylinder and finally dropping on the base frame of the shell resulting in corrosion or dropping on the electrical elements resulting in electric leakage. Therefore, the safety of the washing machine is increased and the service life is prolonged.

Figure 25:
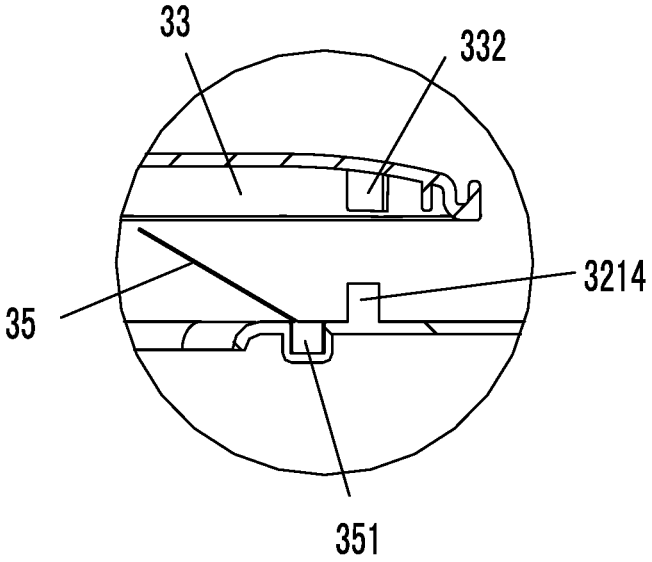
FIG. 25 is a schematic enlarged view of the K region in FIG. 24.

The wiping plate 35 is a thin plate and disposed on the outer cylinder cover 321. The inner cover is in an upwardly arched structure, the upper part of the wiping plate 35 is in contact with the inner cover 33 by the means that the wiping plate 35 is tilted upwards. When the inner cover 33 is opened, the water droplets on the lower surface of the inner cover 33 are blocked by the wiping plate 35. Preferably, the wiping plate 35 is tilted backwards, that is to say, towards the closing direction of the cover 33. The wiper plate body 352 is disposed at an angle from 10° to 90° with respect to the horizontal plane where the outer cylinder cover 321 is in. The position where the upper part of the wiping plate 35 is in contact with the inner cover is above the clothes access 3211 so that the scraped water drops directly into the inner cylinder. The sliding direction of the inner cover 33 when opened is opposite to the direction of inclination of the wiping plate 35 so that the wiping plate 35 and the inner cover 33 fit more closely and water droplets on the lower surface of the inner cover 33 are more thoroughly scraped off, as shown in FIG. 24 and FIG. 25.

The angle between the wiping plate 35 and the plane where the outer cylinder cover 321 is in preferably 10° to 30° or the angle between the wiping plate body 352 and the horizontal plane of the clothes access 3211 is preferably 10° to 30°. Preferably, the angle between the wiping plate body 352 and the horizontal plane where the inner surface of the outer cylinder cover 321 is 25°. The wiping plate 35 is tilted upward by a small angle so that the water droplets on the inner cover 33 removed by the wiping plate 35 falls directly into the inner cylinder rather than flow down along the wiping plate 35.

The wiping plate 35 is made of elastic materials, such as rubber. The wiping plate 35 with great elasticity could be in close contact with the inner cover 33 and therefore the water on the inner cover 33 could be removed cleaner. In other embodiments, it is acceptable only a portion where the wiping plate and the inner cover are in contact is made of elastic material.

When opening the inner cover 33, the upper portion of the wiping plate 35 is in contact with the inner cover 33, and the inner cover 33 exerts a forward force on the wiping plate 35. Therefore, the wiping plate 35 should be firmly fixed to the outer cylinder cover 321. A mounting block 351 is disposed at the lower end of the wiping plate 35. A mounting groove 3215 corresponding to the mounting block 351 is opened on the outer cylinder cover 321, and the mounting block 351 is mounted in the mounting groove 3215. The mounting block 351 and the mounting groove 3215 are both in the shape of a square, so that when the forward force exerted by the inner cover on the mounting block 351, the stress bearing area is comparatively sufficient with good stability, thereby ensuring the firmness of installation. The wiping plate 35 is integrally molded with the mounting block 351. The wiping plate 35 is upwardly tilted relative to the mounting block 351 after molding, and the angle between the wiping plate 35 and the panel where the top surface of the mounting block 351 in is in the range of 10° to 30°, therefore it is ensured that the angle between the wiping plate 35 and the horizontal plane where the outer cylinder cover 321 is located is 10° to 30° after the mounting block 351 is installed in the mounting groove 3215, which ensures the wiping function of the wiping plate 35.

Figure 23:
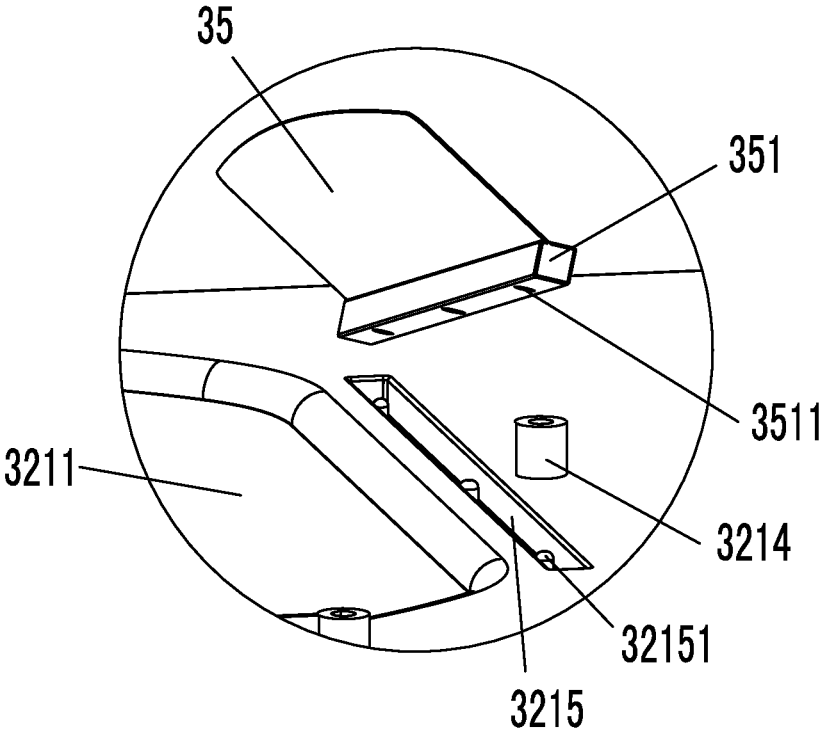
FIG. 23 is an enlarged schematic view of the H region in FIG. 22.

A positioning cylinder 3214 is also provided on the front of the outer cylinder cover 321. A mounting groove 3215 is disposed behind the positioning cylinder 3214, as shown in FIG. 23.

In order to further ensure that the wiping plate 35 is firmly fixed on the outer cylinder cover 321, a fixing structure is provided on the mounting groove 3215 and the mounting block 351 in cooperation. The fixing structure includes a fixing hole and a fixing cylinder. In this embodiment, a fixing cylinder 32151 is disposed on the mounting groove 3215, and a fixing hole 3511 corresponding to the fixing cylinder 32151 is opened on the mounting block 351. When the mounting block 351 is mounted to the mounting groove 3215, the mounting cylinder 32151 is inserted into the mounting hole 3511 to further enhance the firmness of the mounting block 351 when the mounting block 351 is mounted to the mounting groove 3215. The height of the fixing hole 3511 on the mounting block 351 is smaller than the height of the mounting block 351, that is to say, the fixing hole 3511 is a blind hole. After the mounting block 35 is mounted on the outer cylinder cover 321, the user is oblivious to the fixing structure and good in looking.

In this embodiment, the water-proof method of the washing machine comprises the following steps: the inner cover 33 is pushed and slid horizontally, and the inner surface of the inner cover 33 passes through the wiping plate body 352 attached to, the water droplets on the inner surface of the inner cover 33 are blocked by the wiping plate body 352, so that there is no water droplet in the portion of the inner cover 33 where the wiping plate 352 slides. The water droplet drips into the inner cylinder after gathering to some extent at the wiping plate 351. In this way, water drops on the surface of the inner cover 33 are prevented from dropping to the ground or dripping off the top of the shell to drip onto the ground to cause inconvenience to the user.

Figure 26:
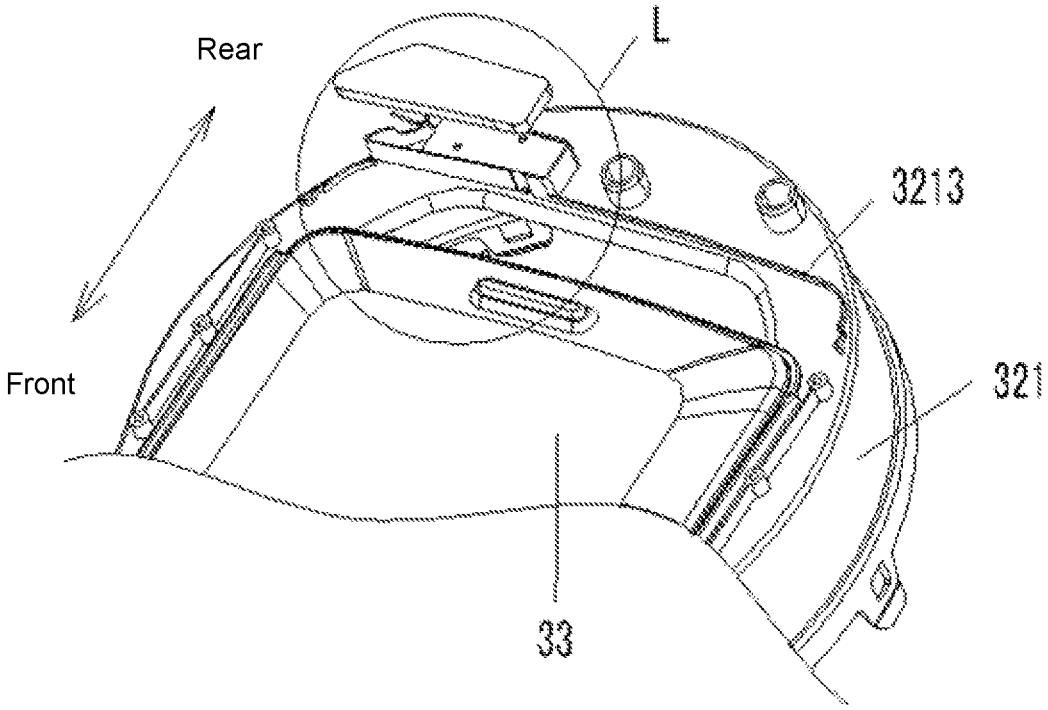
FIG. 26 is an enlarged schematic view of the position that the micro-switch located in FIG. 16.
Figure 27:
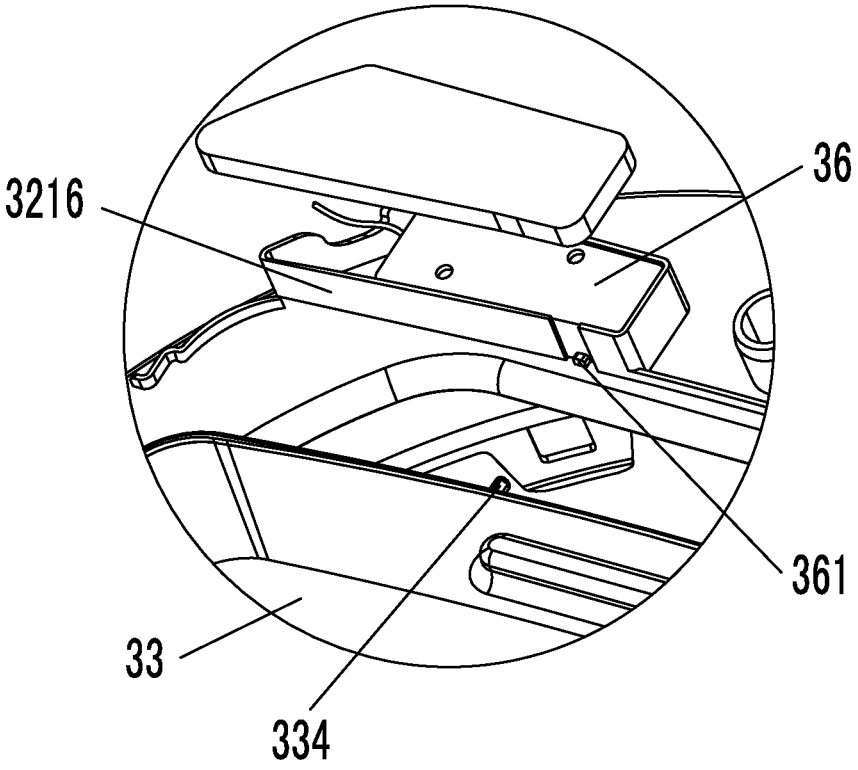
FIG. 27 is an enlarged schematic view of area L in FIG. 26.

Referring to FIGS. 16, 26 and 27, a description will be given to illustrate the micro switch that interlocks with the inner cover provided on the second automatic washing system 3. The second automatic washing system 3 has a heating function. If the inner cover 33 does not reach the closing position or the inner cover 33 is released from the closing position during the wash cycle, the clothes may be thrown out and water vapor may be leaked out resulting in problems as corrosion or burning. In order to solve the problem, a micro switch 36 triggered by the inner cover 33 is provided on the outer cylinder cover 321. When the inner cover 33 is in the closing position, the micro switch 36 is on and the second automatic washing system 3 can start to work; when the inner cover 33 is opened, that is to say, the inner cover 33 leaves the closing position and the micro switch 36 is off. The micro switch 36 is connected in series in the control circuit of the second automatic washing system 3. If the inner cover 33 is not in the closing position and the micro switch 36 is off, the second automatic washing system 3 is not allowed to start to work even receiving signals from the display operation module. As the second automatic washing system 3 enters into the wash cycle and the inner cover 33 is opened and released from the closing position, the second automatic washing system 3 is stopped immediately. By providing the micro switch 36 actuated by the inner cover 33, it is ensured that the inner cover 33 is in the closing position during the washing process of the second automatic washing system 3, the leakage of water vapor, clothes thrown out, burning and collision are prevented.

In this embodiment, as shown in FIGS. 26 and 27, the micro switch 36 is disposed at the rear part of the outer cylinder cover 321. A switch actuator 361 protruding forwards is provided on the front end surface of the micro switch 36. When the inner cover 33 is at the closing position, the inner cover 33 is in contact with the switch actuator 361 to actuate the micro switch 36. Owing to the displacement that the inner cover 33 slides back and forth to open or close and the micro switch 36 is provided with a switch actuator 361 protruding forward, when the inner cover 33 is being closed, the inner cover 33 slides forwards until it reaches the closing position where the rear end surface of the inner cover 33 presses against the switch actuator 361 to trigger the micro switch 36, that is to say, the front end of the inner cover 33 serves as the actuator and there is no need to provide further actuator on the inner cover 33. The structure of the actuator is simple with low cost.

In order to prevent water droplets from falling on the micro switch 36, the micro switch 36 is arranged inside the casing 3216, and the casing 3216 is fixed on the outer cylinder cover 321. A through hole from where the switch actuator 361 penetrates is opened at the front wall of the casing 3216. The casing 3216 is designed to ensure the reliability of the micro switch 36 by preventing the water droplets falling on the micro switch 36 which may reduce the service life of the micro switch 36. The casing 3216 includes a casing body and an upper cover, wherein the casing body and the outer cylinder cover 321 is integral by molding.

As shown in FIG. 27, the switch actuator 361 placed in the casing 3216 protrudes from the though hole but does not protrudes out of the casing 3216 to avoid being wrongly pressed. Further, a trigger 334 corresponding to the switch actuator 361 is provided on the inner cover 33 and the trigger 334 protrudes backwards out of the inner cover; when the inner cover 33 is at the closing position, the trigger 334 presses against the switch actuator 361 backwards to actuate the micro switch 36.

A stopper baffle 3213 is provided at the rear part of the outer cylinder cover 321 to ensure the tightness as the inner cover 33 at its closing position. To be specific, the rear end surface of the inner cover 33 is attached to the stopper baffle 3213 and the front end surface of the inner cover 33 is attached to the front end surface of the casing 3216, namely part of the front end surface of the casing 3216 serves as a part of the stopper baffle 3213, or that is to say the stopper baffle 3213 is broken at the position of the casing 3216.

The above description is only the preferred embodiments of the present invention, but not intended to limit the present invention in any other form. Any skilled person familiar with the art may use the disclosed technical solution to acquire equivalent embodiments merely by simple modifications. Various modifications thereof not departing from the spirit and scope of the present invention may also fall within the scope of the disclosure.

What we claimed is:

1. A washing machine with dual washing systems comprising:

a shell, a first automatic washing system and a second automatic washing system, the first automatic washing system and the second automatic washing system are disposed in the shell; the shell has a first washing area accommodating the first automatic washing system and a second washing area accommodating the second automatic washing system, the first washing area and the second washing area are arranged along the direction from left to right; an included angle forms by a first vertical plane where the axis of the first automatic washing system and the axis of the second automatic washing system lie in and a second vertical plane passing through the center line of the top of the shell and separating the shell into left and right positions;

wherein the second automatic washing system includes a second washing cylinder, an outer cylinder cover is arranged on the second washing cylinder, a clothes access and an inner cover sliding to open and close the clothes access are provided on the outer cylinder cover and a receiving area for receiving the opening inner cover is provided inside the shell; and wherein the left and right ends of the inner cover extend outwardly forming sliding pieces along the horizon direction, and two pressing pieces are provided on the outer cylinder cover on the left and right sides of the clothing access, a sliding trail receiving one of the sliding pieces is provided between one of the pressing piece and the outer cylinder cover.

2. The washing machine with dual washing systems according to the claim 1, wherein the first automatic washing system and the second automatic washing systems are fully automatic washing system, and a water supply system and a drainage system is used by the first automatic washing system and the second automatic washing system together.

3. The washing machine with dual washing systems according to the claim 1, wherein a control system controls the first automatic washing system and the second automatic washing system and the spinning cycle of the first automatic washing system and the second automatic washing system starts at different time under the control of the control system.

4. The washing machine with dual washing systems according to the claim 1, wherein the shell has an auxiliary functional area adjacent to the first washing area and the second washing area, the auxiliary functional area and the second washing area are arranged back and forth, the auxiliary functional area and the first washing area are disposed along the direction from left to right.

5. The washing machine with dual washing systems according to the claim 4, wherein the auxiliary functional area is provided with a storage module, a health module or a third automatic washing system.

6. The washing machine with dual washing systems according to the claim 4, wherein the washing machine further has a display operation module disposed on the top of the auxiliary functional area.

7. The washing machine with dual washing systems according to claim 1, wherein the first automatic washing system comprises a first washing cylinder, the second automatic washing system comprises a second washing cylinder, and the distance between the first washing cylinder and the second washing cylinder is 15 mm to 30 mm or higher.

8. A washing machine with dual washing systems comprising:

a shell, a first automatic washing system and a second automatic washing system, the first automatic washing system and the second automatic washing system are disposed in the shell; the shell has a first washing area accommodating the first automatic washing system and a second washing area accommodating the second automatic washing system, the first washing area and the second washing area are arranged along the direction from left to right; an included angle forms by a first vertical plane where the axis of the first automatic washing system and the axis of the second automatic washing system lie in and a second vertical plane passing through the center line of the top of the shell and separating the shell into left and right positions;

wherein the shell comprises a frame and a shell body which is arranged on the outside of the frame, wherein the frame comprises an upper frame, a base and a plurality of vertical beams which are arranged between the upper frame and the base, the upper frame is provided with an upper middle beam in the front-rear direction, a bottom middle beam in the front-rear direction is arranged on the base, the vertical plane comprising the upper middle beam and the bottom middle beam divides the room enclosed by the shell into left and right parts; and wherein the upper middle beam is provided with a first hanging structure holding the first automatic washing system and a second hanging structure holding the second automatic washing system, the upper middle beam, the first hanging structure and the second hanging structure are in one piece by molding.

9. The washing machine with dual washing systems according to the claim 1, wherein the outer cylinder cover is provided with a wiping plate; when the inner cover is opened, the wiping plate removes water droplets from the lower surface of the inner cover.

10. The washing machine with dual washing systems according to the claim 9, wherein the wiping plate inclines towards the closing direction of the inner cover and is tilted upwardly by a certain angle.

* * * * *